US006330892B1

(12) United States Patent
Shimono

(10) Patent No.: US 6,330,892 B1
(45) Date of Patent: Dec. 18, 2001

(54) WOVEN SLIDE FASTENER BELT WITH DIFFERENTLY CONSTRUCTED ATTACHING AND BODY REGIONS

(75) Inventor: Muchiji Shimono, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/535,369

(22) Filed: Mar. 24, 2000

(30) Foreign Application Priority Data

Apr. 14, 1999 (JP) ..... 11-107060

(51) Int. Cl.[7] ..... D03D 25/00; A44B 19/56
(52) U.S. Cl. ..... 139/384; 139/384 B; 24/393
(58) Field of Search ..... 139/383 B, 384 B; 66/195, 193; 24/393

(56) References Cited

U.S. PATENT DOCUMENTS 3,580,295 * 5/1971 Jisa ..... 139/383 B
3,728,876 * 4/1973 Richard et al. ..... 139/383 B
3,807,462 4/1974 Nogai ..... 139/384
3,880,202 * 4/1975 Mohelnicky et al. ..... 139/383 B
4,334,556 6/1982 Fröhlich et al. ..... 139/384
4,678,013 7/1987 Ofusa et al. ..... 139/384
4,918,793 * 4/1990 Spindler ..... 66/195

FOREIGN PATENT DOCUMENTS 0 448 265 A1 9/1991 (EP) .

* cited by examiner

*Primary Examiner*—Andy Falik
(74) *Attorney, Agent, or Firm*—Finnegan, Henderson, Farabow, Garrett & Dunner, L.L.P.

(57) ABSTRACT

A belt is provided in which no deviation of pattern is generated in the warp yarn and weft yarn despite its low weft yarn density and flexibility, provides stability in attaching various elements and fits to an object. The belt is woven with warp yarn and weft yarn, wherein said belt is sectioned to an element attaching region and a tape proper region in a width direction. In the tape proper region, a loop is formed with weft yarns running throughout substantially an entire width of the belt and that loop is caught with a loop formed by other weft yarns arranged in parallel.

15 Claims, 18 Drawing Sheets

WOVEN SLIDE FASTENER BELT WITH DIFFERENTLY CONSTRUCTED ATTACHING AND BODY REGIONS

BACKGROUND OF THE INVENTION

1. Field of the Invention

The present invention relates to a belt to which slide fastener elements, snap fasteners, curtain hanging device or other elements can be attached, and more particularly, to a belt in which configuration of weaving structure is stabilized despite its low weft yarn density and excellent flexibility.

2. Description of the Related Art

A conventional belt is woven by increasing the densities of warp yarns and weft yarns so as not to produce gaps in the weaving structure in order to stabilize the configuration of a weaving structure for preventing deviation of pattern. With such a weaving structure, element attaching region of the belt, for example, an element attaching region of slide fastener elements, snap buttons, curtain hooks or the like always keeps a stabilized structure, so that the respective elements can be attached firmly without producing a deviation of pattern in the belt and further, the respective elements can exert their stabilized function.

However, according to the aforementioned woven belts, because a tape proper region in the belt, namely a portion for attaching the belt to an object to be attached by sewing or the like, has the same weaving structure as the element attaching region, the tape proper region lacks flexibility and the belt cannot be attached firmly and is unable to fit well to the object to be attached.

On the other hand, cloth woven by employing both weaving and knitting has been disclosed in, for example, U.S. Pat. No. 3,880,202 and U.S. Pat. No. 3,885,601. According to these disclosures, a plurality of weft yarns are arranged in the width direction of the cloth and each of the weft yarns is returned back in each of plural sectioned region in the width direction of the cloth so as to be caught with warp yarns to be woven. Meanwhile, a loop formed at a return end of each weft yarn is caught with a loop formed at the return end of the weft yarn in an adjacent region so as to produce cloth.

Therefore, the cloth obtained in this way has a structure in which plural narrow tapes are connected with each other via a loop in the width direction, so that no deviation of the pattern of the weft yarn occurs. However, in a wale portion in which respective loops are caught, the cloth is likely to be folded in the width direction and elongated or contracted easily, thereby lacks stability of the configuration as a cloth. Thus, such a cloth is not easy to handle. Further, in this cloth, the aforementioned wale portions are formed throughout the entire width thereof at an equal interval in the width direction of the cloth. Therefore, it is not suitable for a belt to which the aforementioned attaching elements are to be attached.

SUMMARY OF THE INVENTION

The present invention has been achieved to solve abovementioned problems, and therefore, an object of the invention is to provide a belt having an excellent attachment stability to various elements and fitting property to an object to be attached. Another object of the invention is to provide a belt, in spite of its very low weft yarn density and excellent flexibility, no deviation of weft yarn pattern is occurred, thereby ensuring excellent productivity and configuration stability, and also an excellent operability for attachment thereof to an object to be attached.

To attach coupling elements of the above-mentioned slide fastener or other various elements such as a snap fastener or the like to a belt, at least the structure of an attaching region needs to lack flexibility and stable in configuration. On the other hand, to attach the belt having such elements by sewing or other means onto an object to be attached such as various clothes and bags, the belt needs to adapt well to the object.

Recently, the belt having the above mentioned elements, for example, slide fastener or snap fastener with tape, has been attached to thin, flexible object to be attached such as baby clothes and underwear. Therefore, there is a strong demand to a tape proper region, which is an attaching portion of the belt to the object, to be made of thin, flexible material. The same demand is also applied even when the object has some extent of stiffness.

Namely, this kind of belt needs to have regions with opposite functions: a region which lacks flexibility and a region having an excellent flexibility, if possible. Further, both regions must be stabilized in configuration.

As a result of considerations, the inventor of this invention paid attention to a fact that by forming a knitted portion using a knitting needle in a weaving structure, a deviation of the weft yarn pattern is suppressed so that the weaving structure can be stabilized as in the cloth disclosed in the aforementioned US patent specification, even in a belt of which a basic structure is obtained by weaving, although the belt has a very low weaving density and rough weave pattern. Further, the inventor has also discovered that it is advantageous to form the loop of the woven portion by of weft yarn running substantially throughout an entire width of the belt in order to stabilize the woven configuration.

A first aspect of the present invention has the basic feature obtained by such consideration. In the feature, there is provided a belt woven with warp yarn and weft yarn, characterized in that the belt is sectioned to element attaching region and tape proper region in a width direction thereof, and a loop is formed of weft yarns running over substantially an entire width of the belt in the tape proper region while the loop is caught with a loop formed with other weft yarns running in parallel.

In other words, according to this invention, the belt is sectioned to an element attaching region on which to attach elements such as coupling element of the slide fastener, snap fastener, curtain hanging device or the like, and a tape proper region to be attached to an object such as clothes and bag. Then, loops are formed in at least a partial region or entire region of the tape proper region by a weft yarn inserted throughout substantially entire width of the belt each time when the weft yarn is inserted and this weft yarn is caught with a loop formed of a weft yarn inserted next time or after. Then, weaving with the weft yarn in the longitudinal direction of the belt is repeated.

Due to the presence of such a weave pattern, the deviation of the weft yarn is prevented and the tape proper region can be provided with flexibility so that it adapts excellently to the object to be attached and smoothness of attachment can be secured. Further, the weaving yarn in the element attaching region, for example, the warp yarn is prevented from being deviated toward the tape proper region by an existence of the weave pattern, thereby stabilizing the weaving structure in the element attaching region so as to ensure a stabilized attachment of the elements.

On the other hand, the present invention does not specify the weaving structure of the aforementioned element attaching region. The reason is that the weaving structure of the element attaching region is determined appropriately depending on the kind of the element and its attachment state, for example, whether the element is formed of synthetic resin and molded integrally on the belt or the element is formed of metal and formed integrally on the belt by crimping. Therefore, according to the present invention, the element attaching region may be formed of only the weaving structure in which the warp yarn and weft yarn are caught with each other or other yarns may be woven into part of the weaving structure, or furthermore, may be knitted by forming knitting patterns by the weft yarn or additionally provided yarn in part of the weaving structure.

The invention further provides a feature of the tape proper region. According to this invention, there is provided a belt, wherein the tape proper region is structured of an ordinary weaving structure consisting weft yarns for forming the loop and warp yarns which catch the weft yarns. Namely, according to the invention, there exist together an ordinary weaving structure in which the warp yarn and weft yarn are caught with each other, and a weaving structure in which a loop formed of the weft yarn is caught with a loop formed of a weft yarn inserted next or after in the tape proper region. With such a feature, in the tape proper region, no deviation of the pattern of the warp yarn as well as weft yarn occurs so that a configuration as a belt is stabilized. Further, the tape proper region adapts well to an object to be attached and therefore, it is possible to attach the object securely and smoothly by sewing or the like.

Preferably, there is provided a belt, wherein a weave pattern of a warp knitting yarn is further caught with the caught loop. This warp knitting yarn is supplied separately from the warp yarn and weft yarn, and caught with a caught portion of loops formed of the weft yarns while forming a warp weave pattern so as to be knitted integrally. Thus, an elongation/contraction of the tape proper region in the longitudinal direction is suppressed largely, so that as compared to weaving with only the weft yarns, the configuration of the tape proper region is stabilized much more.

Further preferably, there is provided a belt, wherein the element attaching region is formed by weaving with only warp yarns and weft yarns. With such a structure, stability of the configuration as a woven fabric and some extent of stiffness are secured, and stabilized attachment of the elements is ensured.

Still preferably, there is provided a belt, wherein the loop is formed of all weft yarns adjacent each other and the respective loops are caught with each other successively in the longitudinal direction of the belt so as to form continuous loop row in the longitudinal direction of the belt. With formation of such a loop row, when the tape proper region is sewed to an object to be attached, the loop row serves as a guide line for sewing. Therefore, a secure and stabilized sewing work is enabled.

It is preferable that there is provided a belt wherein the entire tape proper region is formed by catching the loops by the weft yarn. Namely, according to the invention, there is no warp yarn in the tape proper region, so that its entire region is formed with the weft knitting structure. Therefore, the tape proper region of the present invention is very excellent in flexibility and stretching property like ordinary weft knitted product. Thus, this adapts well to clothes such as knitted fabric for example, and therefore, waving or the like which is likely to occur to an object to be attached when the belt is sewed never occurs, and a beautifully finished product is obtained. In this case, the weaving structure of the element attaching region is not restricted to any particular one, but an ordinary weaving structure with the warp yarn and weft yarn as mentioned previously is preferable in viewpoints of the configuration stability.

It is further preferable that there is provided a belt wherein the weft yarn consists of two yarns running in the same warp yarn opening in a reciprocating manner. As mentioned previously, it is assumed that the above-mentioned weft yarn may be comprised of a single weft yarn by an ordinary one pick, but according to the invention, a known narrow-width needle loom is employed so that the weft yarn consists of two yarns running (two picks) in a reciprocating manner through a shed formed with an opening of the warp yarn. Therefore, when the density of the weft yarn in this ordinary kind of the belt is set large to prevent a deviation of the pattern of the weft yarn, the belt is entirely stiffened as described above so that it is difficult especially to adapt itself to an object to be attached and further, trouble may occur in attachment to the object by sewing or the like. However, according to the invention, as no deviation of the weft yarn pattern occurs as well as flexibility is secured by a loop catching structure formed by the weft yarns, even when the density of the weft yarn is set smaller than that of the conventional weft yarn, the stability in configuration is secured. This further leads to reduction of use amount of the weft yarn, thereby making it possible to achieve low production cost.

It is still preferable that there is provided a belt wherein the weft yarn is composed of two yarns running in the same warp yarn opening in a reciprocating manner and the loop is formed by one of the two yarns. In this case, one of two yarns forming one weft yarn is knitted into by forming a loop, and the other one is inserted linearly into an opening as a proper weft yarn. As a result, knitting structure is added to the entire weaving structure of the tape proper region so that the tape proper region is provided with further improved flexibility and configuration stability. Of course, it is possible to form a loop by using both of the two yarns forming the weft yarn.

Preferably, there is provided a belt, wherein each of the two yarns forming the weft yarn forms a loop at a predetermined pitch in a width direction of the tape proper region while the loop of each yarn is caught with a loop formed by a yarn corresponding to the adjacent weft yarn. According to this invention, since a weave pattern formed by catching of the loops is disposed regularly at a predetermined interval in the tape proper region, uniform flexibility and configuration stability are secured throughout the entire tape proper region.

Preferably, there is provided a belt, wherein the weft yarn composed of two yarns running in the same warp yarn opening in a reciprocating manner includes one or more first weft yarns returning in the tape proper region and a second weft yarn disposed subsequent to the first weft yarn for forming a woven tape selvage portion at an outside edge of the tape proper region, while a loop formed at a return end of the first weft yarn adjacent the second weft yarn is caught with a loop formed at a return end of the second weft yarn.

Thus, the selvage portion of the tape is woven by tying the plural warp yarns arranged in parallel with the second weft yarn at an interval of every one or more first weft yarn. As a result, the warp yarns expand outward of the selvage portion between one or more first weft yarns in forms of loops, so that a belt having bunches on its side edge is obtained and therefore, a design effect can be expected.

Further preferably, there is provided a belt, wherein a reinforcement yarn is further inserted into the tape selvage portion while the reinforcement yarn is caught with the loop in the tape proper region in which the first weft yarn is caught with the second weft yarn. Insertion of the reinforcement yarn not only improves the strength of the selvage portion but also stabilizes configuration of the selvage portion.

There is stipulated a disposition of the element attaching region and tape proper region of the belt. It is preferable that there is provided a belt wherein the element attaching region is disposed in the center in the width direction of the belt and the tape proper region is disposed on both ends in the width direction of the belt. It is also preferable that the element attaching region is disposed on one side in the width direction of the belt while the tape proper region is disposed on the other side in the width direction of the belt. It is still also preferable that two or more element attaching regions and tape proper regions are disposed alternately.

The dispositions of the element attaching region and tape proper region of the belt differ because the attachment positions change depending on the kind of the element. One of the aspects of the invention is preferable for a belt in which a snap fastener is attached in a central portion in the width direction thereof as an attaching element. As a typical example of another aspect of the invention, a fastener tape or header tape for a slide fastener, in which coupling elements or curtain hanging device as an attaching element is to be attached along a side edge thereof can be given.

Finally, there is provided a belt, wherein an upper/lower leg portion of each of the coupling element portions comprising coil-like coupling element row of a slide fastener is disposed above the weft yarn in the element attaching region, while the upper/lower leg portion is tied with the weft yarn by warp yarns integrally, so that loop row of the weft yarn is formed near the tape proper region of the element attaching region, thereby providing a typical belt which can prevent a deviation of the element attaching region toward the tape proper region which has a small warp yarn density and is flexible. As another example, the belt can be used for a snap fastener tape in which plural snap fasteners are disposed in a width direction thereof such that they extend in line in the longitudinal direction thereof.

DESCRIPTION OF THE PREFERRED EMBODIMENTS

Figure 1:
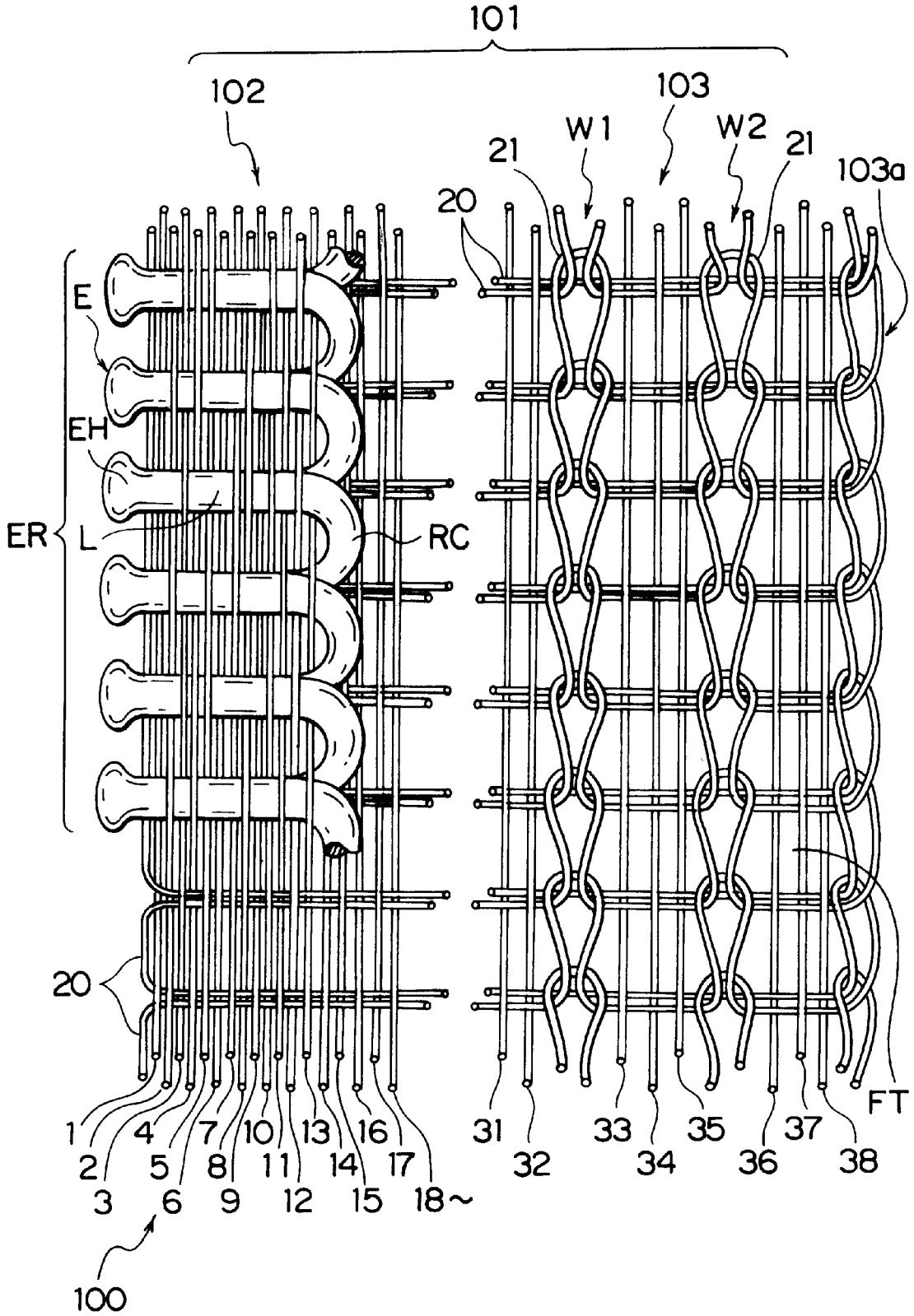
FIG. 1 is a partial plan view of a first embodiment showing a slide fastener stringer in which a belt of the present invention is employed as a fastener tape by breaking it out partially.

Hereinafter, the preferred embodiments of the present invention will be described in detail with reference to the accompanying drawings. FIG. 1 shows a typical embodiment of the present invention and is a plan view showing the coupling element rows by breaking out part thereof while indication of a central portion in the width direction of a fastener tape which is a belt of the present invention incorporating coil-like coupling element rows of a slide fastener into a side edge thereof is omitted. For description of subsequent embodiments and modifications, same reference numerals are used for the substantially same components for better understanding.

Although various warp yarns and weft yarns are represented in relatively small sizes for convenience for understanding in all of the attached drawings, actual yarns having a required size are used depending on their purposes.

Further, although the weaving structure is shown roughly, it actually has a required fineness.

A fastener tape 101 according to this embodiment shown in the drawing is comprised of a coupling element row attaching region 102 which is an element mounting region of the present invention and a tape proper region 103 which is to be attached to an object. In the aforementioned coupling element row attaching region 102, a coupling element row ER is incorporated integrally at the same time when the fastener tape 101 is woven and bound therein. A foundation weft yarn 20 which is one of component yarns of the fastener tape 101 is inserted by a needle narrow-width loom which runs in a reciprocating manner (double picks) a carrier bar (not shown) into a shed road of a warp opening and therefore comprises two doubled yarns. The warp yarn consists of a foundation warp yarn constituting a foundation structure of the fastener tape and a binding warp yarn for the aforementioned coupling element row ER.

Ten element row binding warp yarns 2 to 5, 7, 8, 10 to 13 are disposed in the aforementioned coupling element row attaching region 102. A plurality of foundation yarns 1, 6, 9, 14 to 18 to 32 are disposed in the tape proper region 103 and the coupling element row attaching region 102. These warp yarns are arranged successively in the order of the reference numeral from an outside end of the coupling element row attaching region 102 and supplied onto a loom (not shown).

A plurality of coupling element portions E molded continuously in a coil shape by monofilament made of synthetic resin are woven into the weaving structure of the coupling element row attaching region 102 to be bound. The coupling element portion E is comprised of the coupling head EH extending outward from the coupling element row attaching region 102 of the fastener tape 101, an upper/lower leg portion L extending in parallel inward of the fastener tape 101 from both ends of a direction perpendicular to the fastener tape 101 of the coupling head EH, and a connecting portion RC for connecting each end of the upper/lower leg portion L with either of the upper/lower leg portion L of the coupling element portion E adjacent back or forth in the tape direction.

The coupling element portion E is guided by a carrier bar (not shown) which runs in a reciprocating manner over a predetermined length from an end of the tape to the inner side of the tape when the foundation weft yarn 20 is inserted by double picks and inserted while molded. Therefore, in this embodiment, each of the foundation weft yarns 20 inserted by double picks exists below along the upper/lower leg portion of the coupling element portion E respectively.

A knitting needle (not shown) is inserted into a loop-like return end of the tape proper portion 103 side of the foundation weft yarn 20, and by hooking the inserted return loop end of the foundation weft yarn 20 at a next position, it comes out of the preceding loop end. Then, the loop ends are joined together in succession so as to form an end selvage portion 103*a* of the tape proper portion 103.

According to this embodiment, of the aforementioned binding warp yarns 2 to 5, 7, 8, 10 to 13, the adjacent two binding warp yarns 2 and 3 near the coupling head EH of the coupling element portion E ride over the upper/lower leg portion L while their repeating unit is deviated by a pitch of the coupling element portion E in the longitudinal direction of the tape, and then ride under and run below the foundation weft yarn 20 consisted of two yarns disposed below the upper/lower leg portion L at a next position. Consequently, this is repeated as a unit so that the coupling element portion E is woven into the fastener tape 101 in succession and bound therein.

Two binding warp yarns 4 and 5 following the aforementioned two binding warp yarns 2 and 3 ride over the upper/lower leg portion L of the two coupling element portions E, while the repeating unit is deviated by one pitch as mentioned previously, and runs between below the upper/lower leg portion L of one coupling element portion E at a next position and the foundation weft yarn 20 comprised of two yarns located below the upper/lower leg portion L. Further, it runs below the foundation weft yarn 20 comprised of two yarns and located below the upper/lower leg portion L of the next one of the coupling element portion E. Then, this procedure is repeated. A foundation warp yarn 6 following these two binding warp yarns 4 and 5 is disposed, and rides over and below the adjacent foundation weft yarn 20 alternately, so that it is always located below the coupling element portion E.

Two binding warp yarns 7 and 8 disposed adjacent the foundation warp yarn 6 at the inner side of the tape run in the same repeating unit as the two binding warp yarns 4 and 5. A foundation warp yarn 9 disposed adjacent these binding warp yarns 7 and 8 at the inner side of the tape runs over and below the adjacent foundation weft yarn 20 alternately like the foundation warp yarn 6 so that it is always located below the coupling element portion E.

Four binding warp yarns 10 to 13 disposed following the foundation warp yarn 9 at the inner side of the tape is to bind the connecting portion RC of the upper/lower leg portion L of the coupling element portion E. The respective binding warp yarns 10 to 13 run in the same repeating unit as the binding warp yarns 2 and 3 disposed near the coupling head EH. In other words, the binding warp yarns 10 to 13 ride over a portion near the connecting portion RC of the upper/lower leg portion L and run below the foundation weft yarn 20 disposed below the upper/lower leg portion L at a next position, while the repeating unit is deviated by one pitch of the coupling element portion E in the longitudinal direction of the tape. This procedure is repeated so as to weave the coupling element portion E into the fastener tape 101 in succession and bind it therein.

Further, in this embodiment, the foundation warp yarns 14 to 31 to 38 and the foundation weft yarn 20 constituting the tape proper portion 103 are disposed such that they intersect each other in a zigzag pattern so as to form so-called plane weaving structure. Of all of the warp yarns, a warp yarn density of the binding warp yarns 2 to 5, 7, 8, 10 to 13 and the foundation warp yarns 1, 6, 9, 14 to 18 in the coupling element row attaching region 102 and its vicinity is set higher than the density of the other warp yarns so as to secure stability and some extent of stiffness of the configuration in the coupling element row attaching region 102 and its vicinity.

With above-mentioned feature, in the fastener tape 101 of this embodiment, when producing the slide fastener, the slide fastener stringer 100 is structured by incorporating the aforementioned coupling element row ER, and the coupling element rows ER opposing each other of a pair of the slide fastener stringers 100 are coupled each other. In this state, the coupling element row ER are cut out partially in a desired length with an interval of a predetermined length of the slide fastener to be finally completed, so as to form a space portion. At this time, at an end of the coupling head EH side of the fastener tape 101 in the space portion, the foundation warp yarn 1, the binding warp yarns 2 and 3 run over and below the foundation weft yarn 20 arranged in parallel alternately, while their pitch is deviated by an amount corresponding to one of the weft yarn 20. For this reason, after the space portion is formed, the respective warp yarns 2 and 3 will not wave upward. Thus, in a subsequent slide fastener manufacturing process such as attaching a stopping device or inserting a slider, there is no influence of the warp yarns 2 and 3 that production thereof is stabilized thereby producing a high quality product under high speed.

According to this embodiment, a loop 21 made by a weft yarn 20 which is the biggest feature of the invention, is formed between three foundation warp yarns 36 to 38 located near an outside edge of the tape proper region 103 and a foundation warp yarn 35 adjacent thereto inward of the tape proper region 103, and further between a foundation warp yarn 33 disposed beyond a single foundation warp yarn inward of the tape proper region 103 from the foundation warp yarn 35 and a foundation warp yarn 32 adjacent thereto further inward of the tape proper region 103, each time when the weft yarn is inserted by double picks using a knitting needle disposed appropriately. The loop 21 of a preceding position is caught with the loop 21 of a next position so that loop rows W1, W2 are formed of two weave patterns continuous in the wale direction. The aforementioned loop 21 of this embodiment is formed with a single piece of the foundation weft yarn 20 composed of two yarns while the other piece runs linearly without forming any loop.

With the formation of such weave pattern, no deviation of the weave pattern of the weft yarn 20 occurs at the outside edge of the tape proper region 103 although the weft yarn density is low. Further, because the entire tape proper region 103 has flexibility, it is well adapted to an object to be attached. Furthermore, because the two loop rows W1, W2 function as guide lines for sewing, the sewing work to an object to be attached is carried out effectively and accurately. Because one of the foundation weft yarns 20 made of two yarns forms the loop 21 while the other one runs linearly without forming any loop, the tape proper region 103 is remarkably stabilized in configuration as a woven fabric. The formation of such a weave pattern enables the coupling element row ER to be attached in a stabilized condition.

Although according to this embodiment, the two loop rows W1, W2 extending in the wale direction are formed near the outside edge of the tape proper region 103 as described above, it is not restricted to two as mentioned, and it is permissible to form an arbitrary number of the loop rows at an arbitrary position in the width direction of the tape proper region 103 through plural rows of warp yarns. For example, when the loop 21 is formed with the foundation weft yarn 20 at a region near the element attaching region 102 of the tape proper region 103, even when the foundation warp yarns are designed in a rough weaving density, no deviation occurs in the warp yarns thereby always achieving stability of the configuration in the coupling element row attaching region 102.

Figure 2:
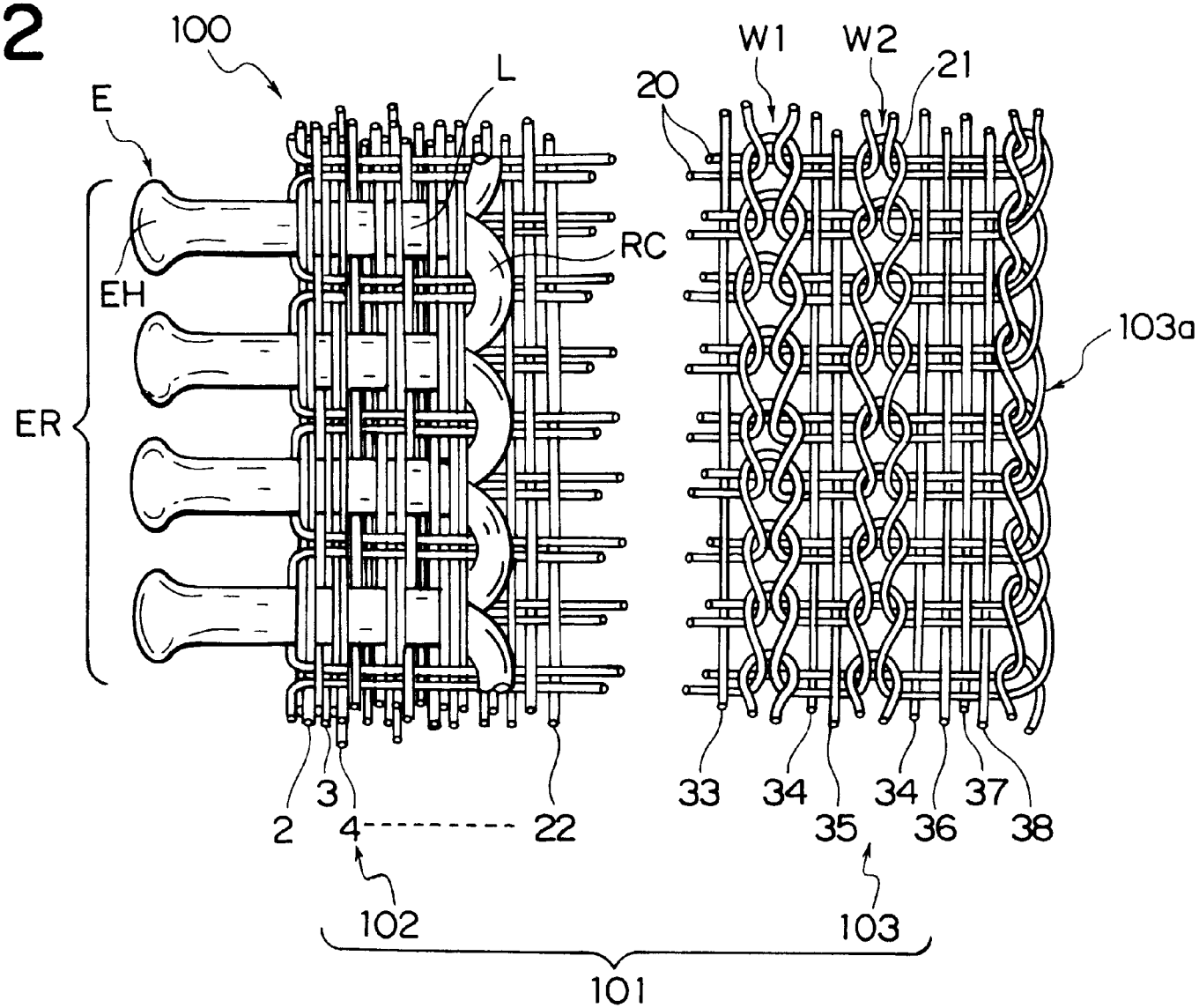
FIG. 2 is the same partial plan view showing a first modification of the slide fastener stringer.

FIG. 2 shows a modification of the aforementioned slide fastener stringer 100. Although in the aforementioned slide fastener stringer 100, the foundation weft yarn 20 is inserted for every pitch between respective element portions E of the coupling element row ER, according to this modification, the foundation weft yarn 20 by double picks is inserted twice for every pitch between the respective element portions E of the coupling element row ER. Therefore, assuming that the sizes of each warp yarn and foundation weft yarn are the same as those of each warp yarn and foundation weft yarn of the above embodiment, the weft yarn density of this case is double that of the fastener tape 101 of the above embodiment.

Figure 3:
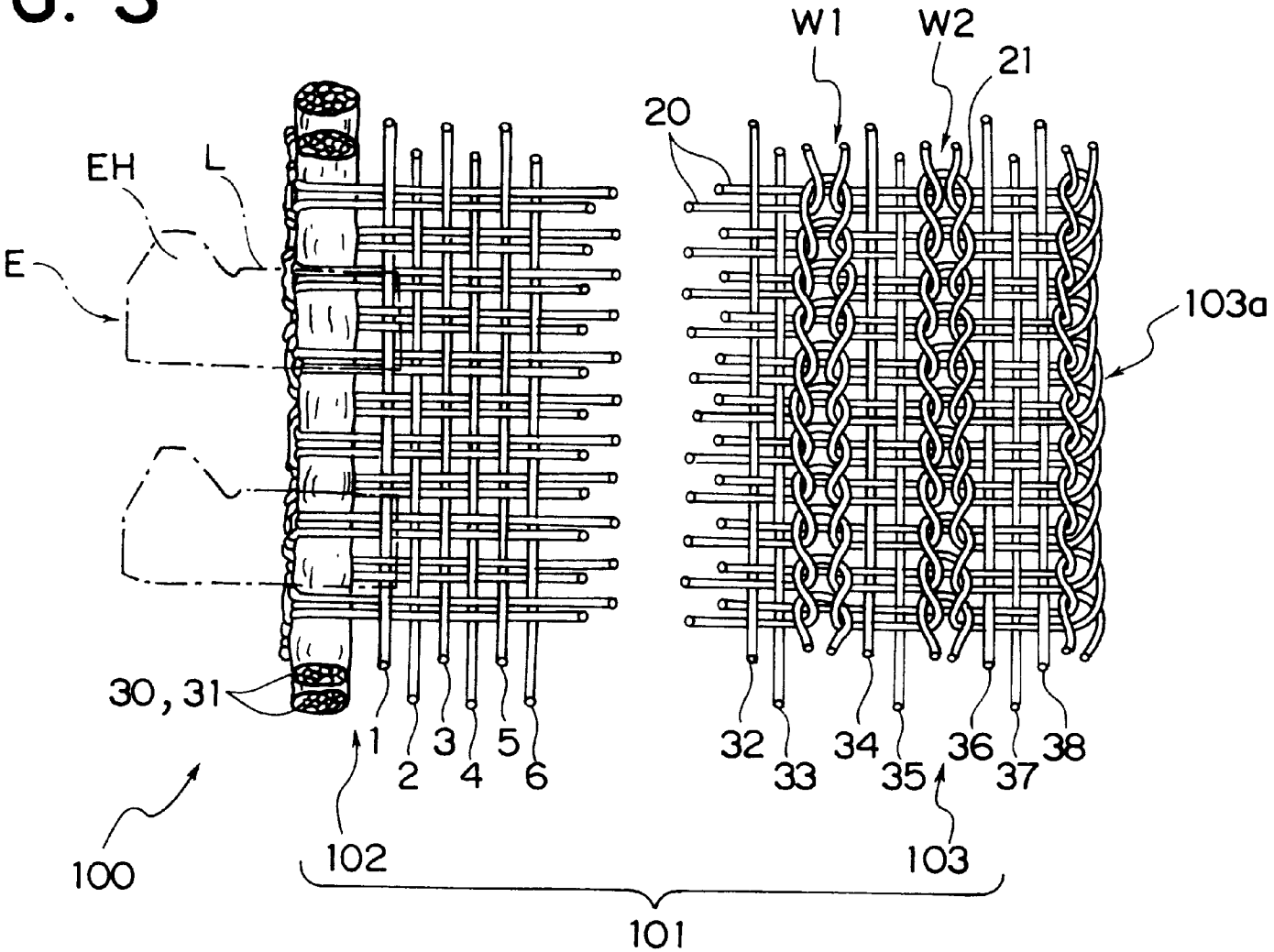
FIG. 3 is a partial plan view showing a second modification thereof.

FIG. 3 is another modification of the fastener tape for the slide fastener like the fastener tape shown in FIGS. 1 and 2. According to this modification, the coupling element (row) is not woven into the fastener tape 101, but after the fastener tape 101 is produced, the coupling elements E of synthetic resin or metal are mounted along a side edge by molding or crimping integrally. For the reason, upon manufacturing of the fastener tape 101, two core threads 30 and 31 are woven in along an outside edge of the element attaching region 102 so as to prevent any coupling element E from slipping out. The other feature is the same as that of the modification shown in FIG. 2.

Figure 4:
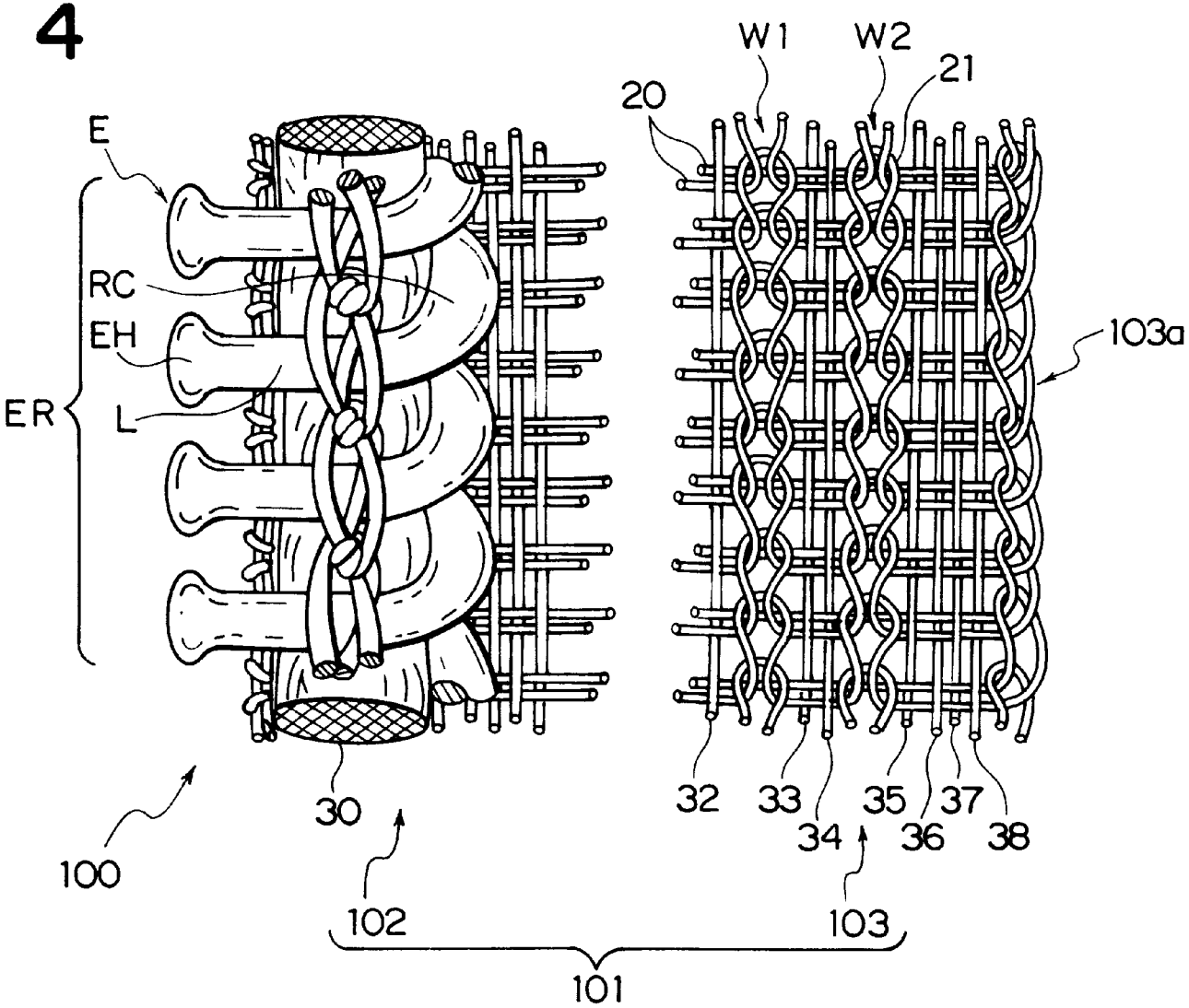
FIG. 4 is a partial plan view showing a third modification thereof.

FIG. 4 shows a third modification of the embodiment shown in FIG. 1. According to this modification, the fastener tape 101 is woven independently like the modification shown in FIG. 3. Unlike the position shown in FIG. 1, the two loop rows W1 and W2 are formed between the foundation warp yarn 35 to 38 which are fourth pieces from an outside edge of the tape proper region 103, and a fifth piece of the foundation warp yarn 34, and between the foundation warp yarn 33 and foundation warp yarn 32 respectively. In the element attaching region 102, coil-like continuous element row ER is provided such that a core thread 30 is inserted in the longitudinal direction and bound to the element row attaching region 102 by sewing.

Figure 5:
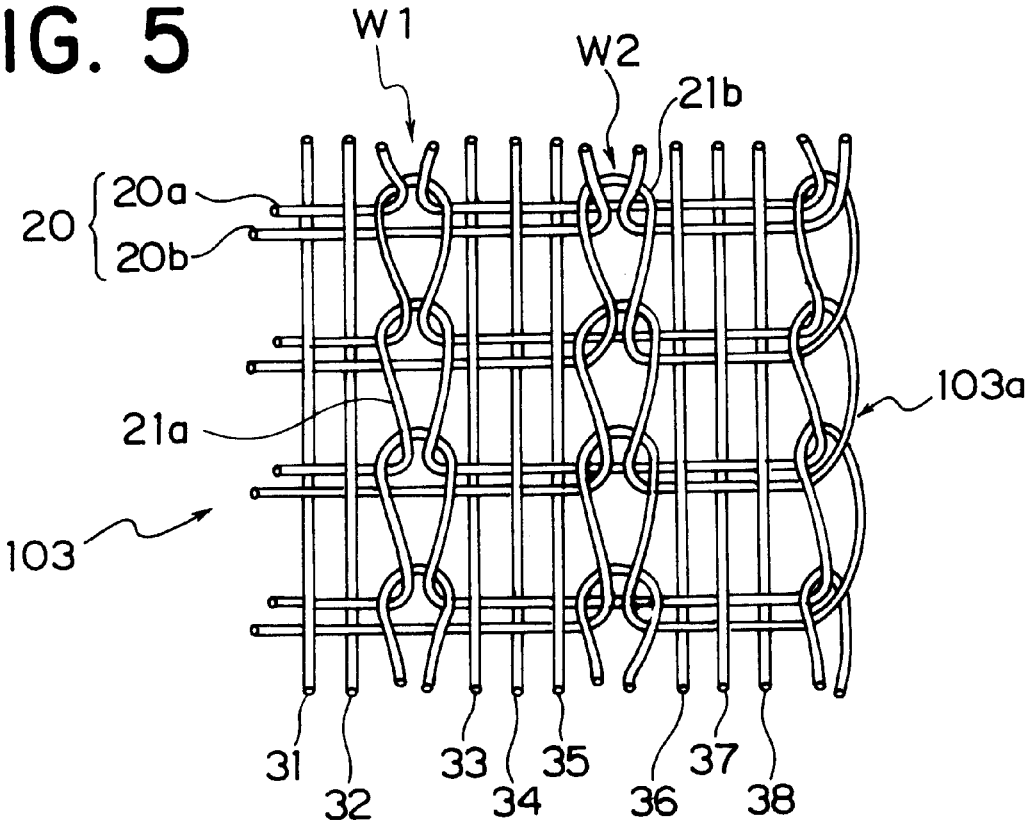
FIG. 5 is a partial plan view of a second embodiment showing a structure of a side edge portion of the belt of the present invention.

FIG. 5 shows a second embodiment of the present invention, in which respective loops disposed at the two loop rows W1 and W2 are formed by each yarn of the weft yarns 20 composed of two yarns, the first and second yarns 20*a* and 20*b* alternately. Namely, the loop 21*a* constituting the loop row W1 to be disposed at the inner side of the tape proper region 103 is formed of the first yarn 20*a*, while the loop 21*b* constituting the loop row W2 to be disposed on outer side of the tape proper region 103 is formed of the second yarn 20*b*. By forming the loops 21*a* and 21*b* in each of the two yarns constituting the weft yarn 20 by double picks, it is possible to apply the first and second yarns with the functions of the loop and weft yarn respectively so that both the configuration and flexibility of the tape are arranged equally.

Figure 6:
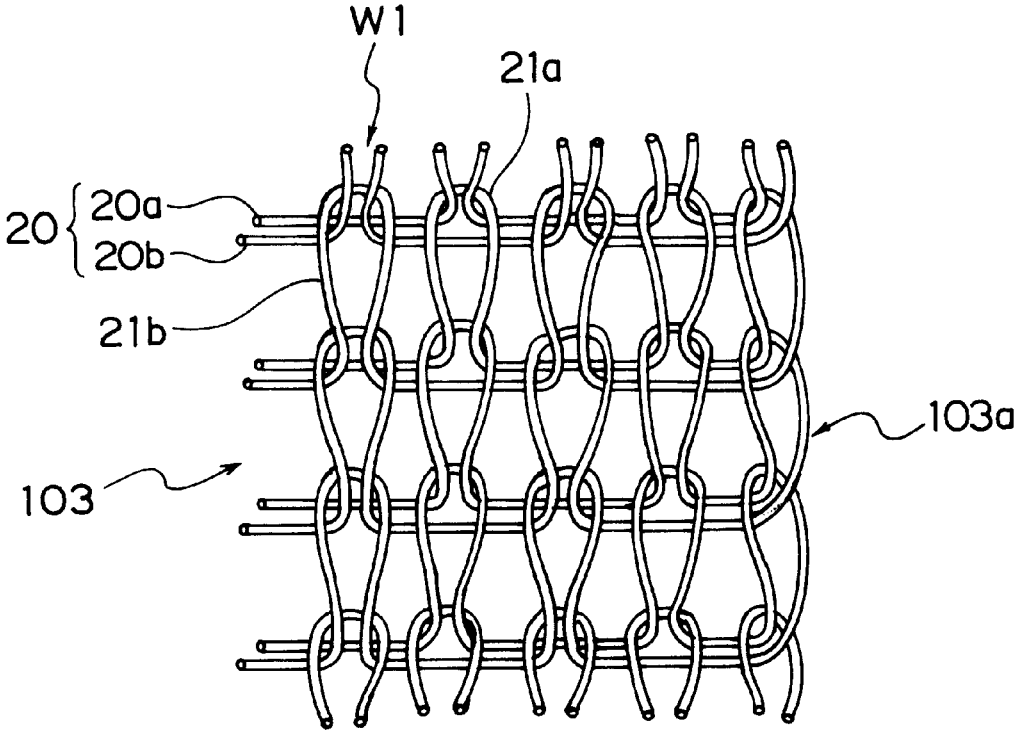
FIG. 6 is a partial plan view of a third embodiment showing a structure of a side edge portion of the belt of the present invention.

FIG. 6 shows a third embodiment of the present invention, in which loops are formed with the weft yarns 20 in an entire tape proper region 103. Therefore, in this embodiment, there is no foundation warp yarn in the tape proper region 103 so that the tape proper region 103 is constituted of only the weft yarns 20. On the other hand, the element attaching region 102 is composed of a weaving structure by catching of the binding warp yarns and foundation warp yarns like the above described embodiments and modifications, although drawing thereof is omitted. According to this embodiment, each yarn 20*a* and 20*b* of the weft yarn 20 composed of the two yarns 20*a*, 20*b* by double picks form the loops 21*a* and 21*b* respectively, so that the loop row is formed alternately in the width direction of the tape proper region 103.

According to this embodiment, as understood from FIG. 6, since the tape proper region 103 is woven with so-called weft knitting structure, flexibility and stretching property particular to the weft knitting structure are secured in the region 103. For example, when an object to be attached is of knitted fabric, the aforementioned tape proper region 103 is well adapted to the knitted fabric product. Thus, upon sewing it to the object, waving along the sewing line or the like which is likely to happen when a conventional woven tape is sewed does not occur, thereby a high quality product having a beautiful appearance being produced.

Figure 7:
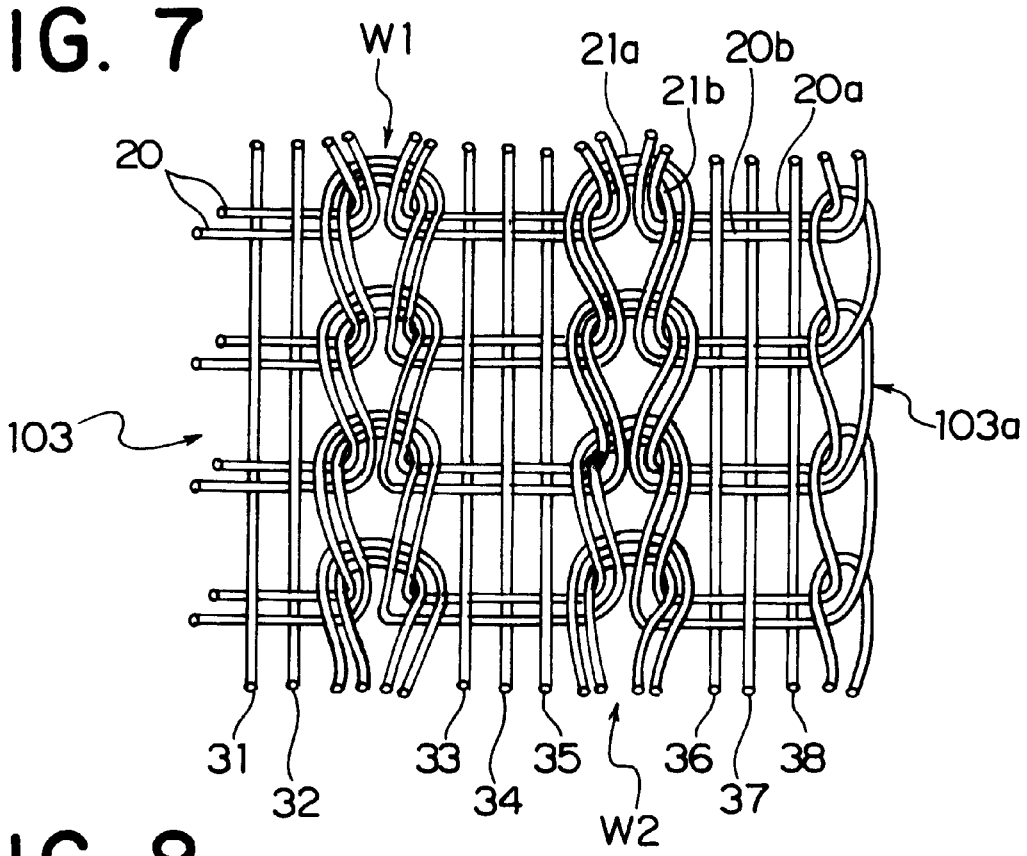
FIG. 7 is a partial plan view of a fourth embodiment showing a structure of a side edge portion of the belt of the present invention.

FIG. 7 shows a fourth embodiment of the present invention, in which equal loops 21*a*, 21*b* are formed with double yarns 20*a* and 20*b*which are formed by doubling the foundation weft yarn 20 composed of two yarns 20*a* and 20*b* by double picks at the same position, as understood from the drawing. These are caught with the loop 21*a*, 21*b* formed with the double yarns 20*a* and 20*b* at a next position so as to form a wale. Such a feature may prevent deviation of a pattern of the weft yarn 20 securely, thereby obtaining a tape proper region 103 much stabilized in configuration despite having flexibility particular to knitting pattern.

Figure 8:
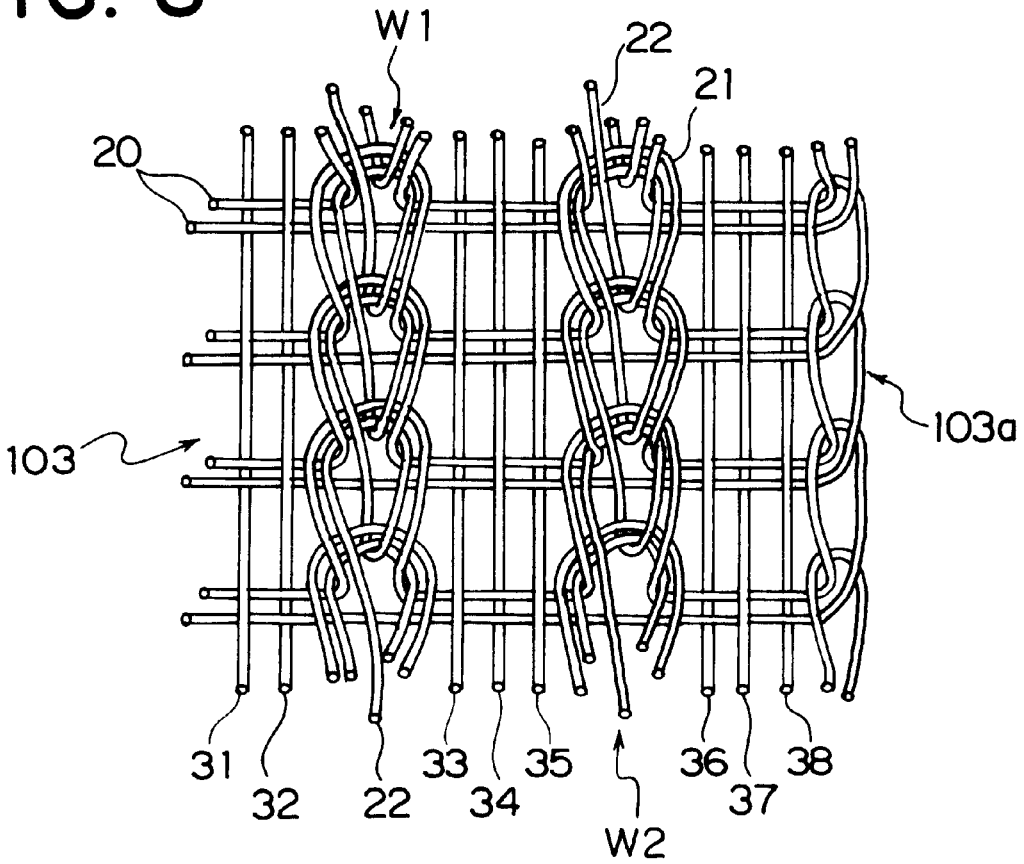
FIG. 8 is a partial plan view of a fifth embodiment showing a structure of a side edge portion of the belt of the present invention.

FIG. 8 shows a weaving and knitting structure of the tape proper region 103 according to a fifth embodiment whose configuration is stabilized more than the tape proper region 103 of the fourth embodiment and in which stretching in the longitudinal direction is suppressed. In this embodiment, a chain stitch yarn 22 is woven additionally into each of the loop rows W1 and W2 of the above described weaving and knitting structure shown in FIG. 1. The additional use of this chain stitch yarns 22 stabilizes the configuration of the knitting structure, particularly by suppressing stretching property in the longitudinal direction. Although the chain stitch yarn is employed as the warp yarn in this example, it is permissible to knit tricot knitting yarn or two needle stitch yarn at the same time or independently.

Figure 9:
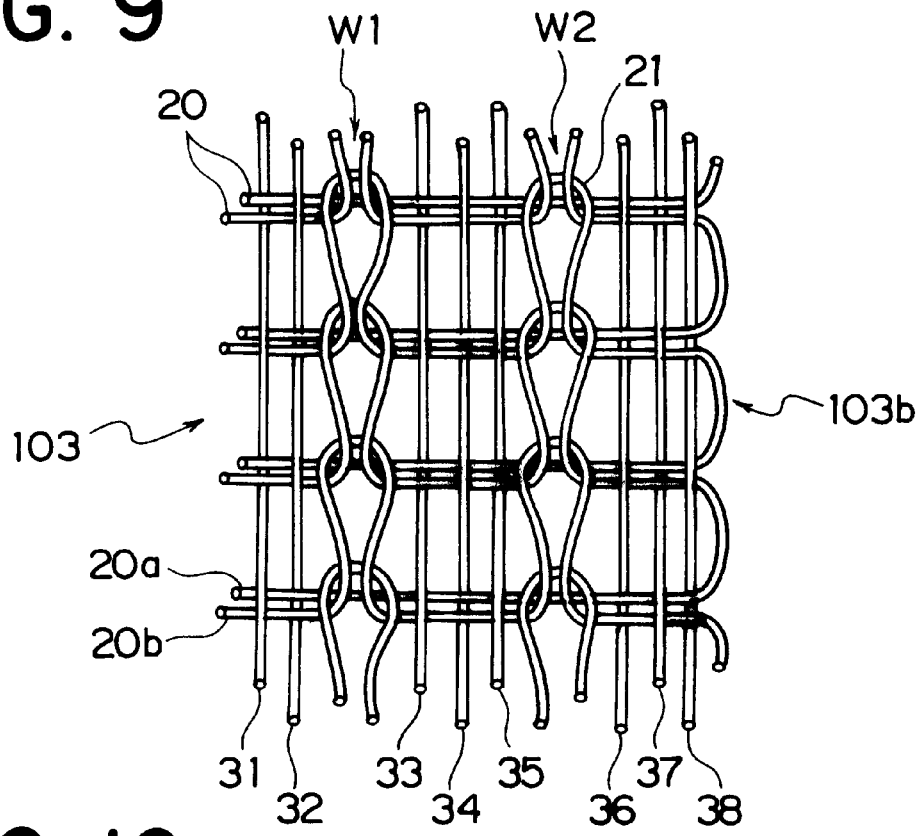
FIG. 9 is a partial plan view of a sixth embodiment showing a structure of a side edge portion on the weft insertion side of the belt of the invention in which the weft yarn is inserted by double picks.

FIG. 9 shows a sixth embodiment in which the tape proper region 103 is disposed at an inserting side of the weft yarns 20 composed of two yarns 20*a* and 20*b* by double picks. Its selvage portion 103b is woven by catching a return yarn 20*b* at a preceding insertion with three foundation warp yarns 36 to 38 at the next insertion.

Figure 10:
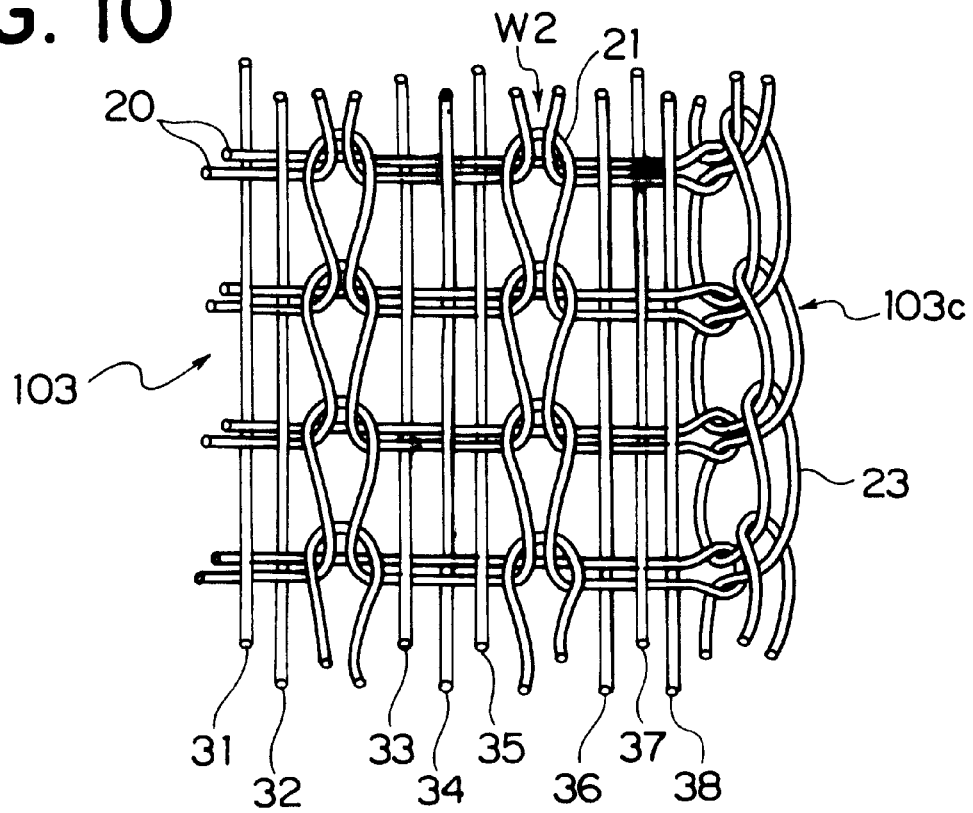
FIG. 10 is a partial plan view of a side edge portion of the belt showing a fourth modification of the first embodiment.

FIG. 10 shows a modification of the edge of the selvage portion 103*a* of the tape proper region 103 shown in the first embodiment. The selvage portion 103*a* is formed by catching loops at the return ends of each of the two yarns 20*a* and 20*b* by double picks at preceding position and next positions according to the first embodiment. According to this modification, however, a selvage yarn 23 is supplied additionally and a selvage portion 103*c* is formed by inserting the loop formed by the selvage yarn 23 into the loop of the return edge of each of the double-pick yarns 20*a* and 20*b* of the preceding and succeeding positions.

Figure 11:
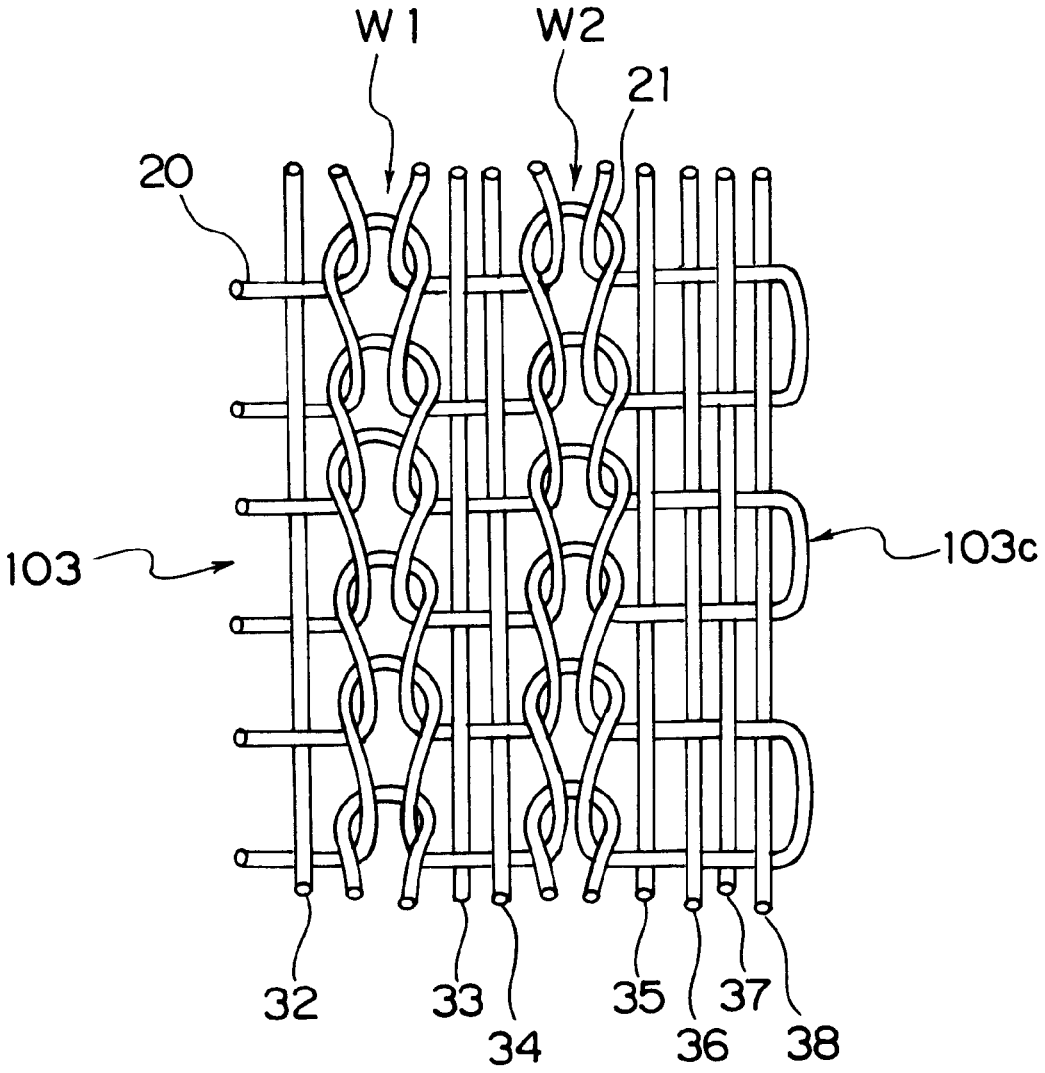
FIG. 11 is a partial plan view of a seventh embodiment showing a structure of a side edge portion of the belt of the present invention.

FIG. 11 shows a seventh embodiment of the present invention. According to the above described respective embodiments and modifications, the weft yarn 20 is comprised of two yarns 20*a* and 20*b* by double picks. However, according to this embodiment, an ordinary loom which inserts the weft yarn by one pick is employed and therefore, the foundation weft yarn 20 consists of a single yarn. With such a feature, quantity of weft yarn used is reduced to ½ as compared to the other respective embodiments if the yarn of the same size is used, as understood easily. Further, wearing of the pattern is prevented effectively by an existence of the loop rows W1 and W2 formed of the weft yarns 20 in the tape proper region 103. Further, because the weft yarn 20 consists of a single yarn, a very thin, flexible tape proper region 103 is formed despite the same structure as the above described respective embodiments.

FIGS. 12 to 15 show an eighth embodiment and its modifications of the present invention.

Figure 12:
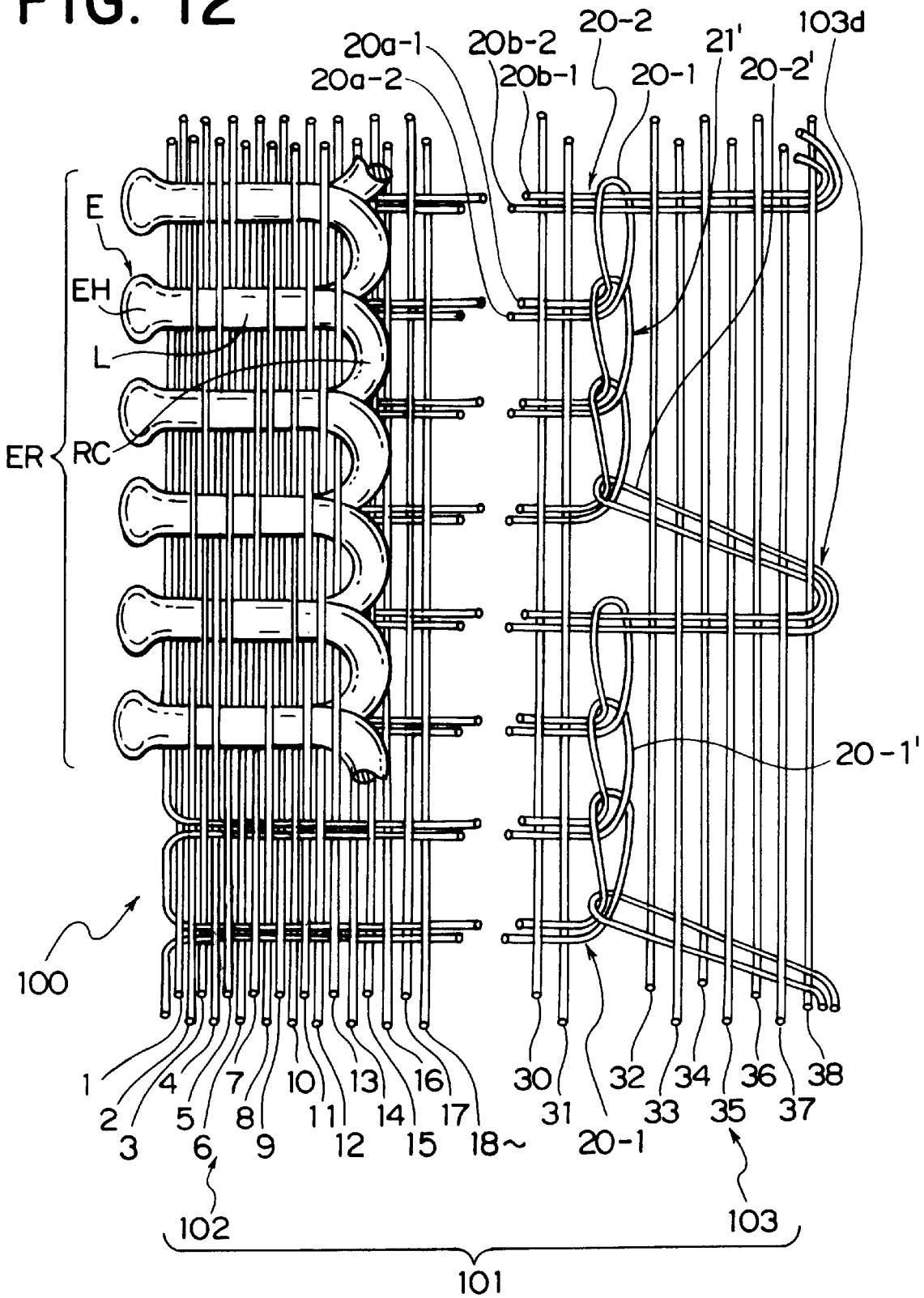
FIG. 12 is a partial plan view of an eighth embodiment showing a slide fastener stringer in which the belt of the present invention is employed as a fastener tape by breaking out part thereof.

According to the embodiment shown in FIG. 12, a continuous loop group 21' is formed between an innermost foundation warp yarn 32 of seven foundation warp yarns 32 to 38 disposed on an outside edge of the tape proper region 103 and a foundation warp yarn 31 disposed internally adjacent the foundation warp yarn 32 by successively catching a loop 20-1' formed at each of the return ends of two yarns 20*a*-1 and 20*b*-1 by double picks of three first weft yarns 20-1. A succeeding second foundation weft yarn 20-2 is inserted into the final loop 20-1' and caught with the seven foundation warp yarns 32 to 38 disposed on the outer edge of the tape proper region 103 and woven. Then, it is returned and caught with the aforementioned seven foundation warp yarns 32 to 38 so as to weave a selvage portion 103*d*.

Then, a loop 20-2' formed at the return end of two yarns 20*a*-2 and 20*b*-2 of the second foundation weft yarn 20-2 weaving this selvage portion 103*d* is caught with the loop 20-1' formed at each return end of two yarns 20*a*-1 and 20*b*-1 of the most preceding first foundation weft yarn 20-1 of three first foundation weft yarns 20-1 inserted successively. This operation is repeated.

With such a feature, the seven foundation warp yarns 32 to 38 are tied at every fourth weft yarn insertion by the second foundation weft yarn 20-2 so that a loop extending outward is formed between the second foundation weft yarns 20-2 adjacent each other. As a result, loop-like bunches are formed along the outside edge of the tape proper region 103 so that a tape having the selvage portion 103d of a peculiar shape is obtained. Therefore, in addition to the above described effect, a design effect is also exerted.

Figure 13:
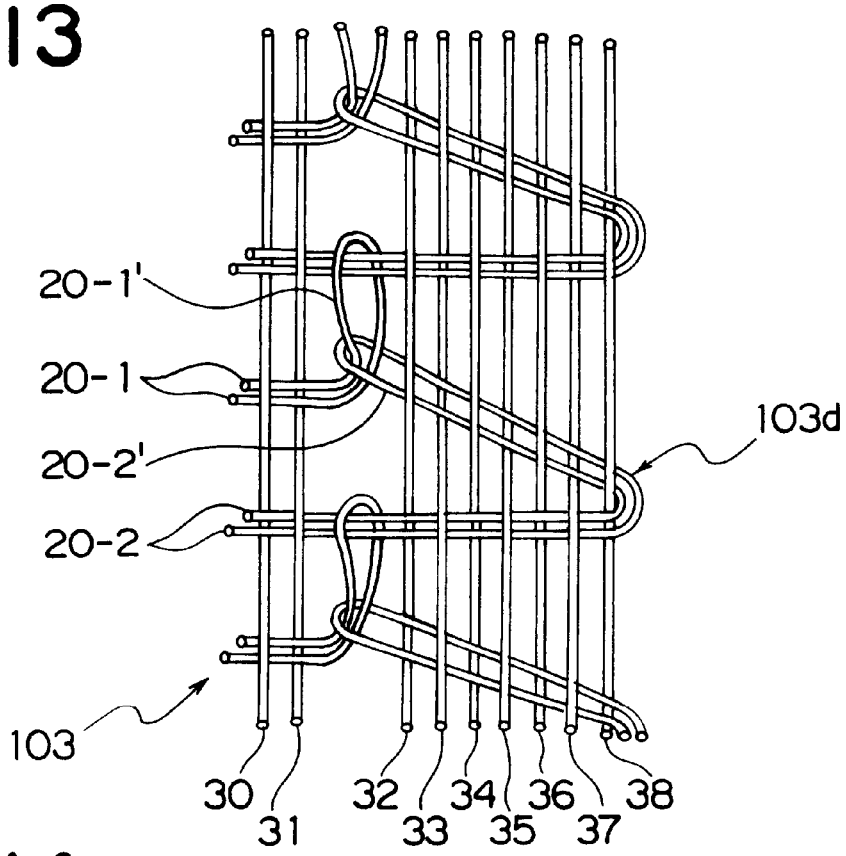
FIG. 13 is a partial plan view showing a modification of the eighth embodiment.
Figure 14:
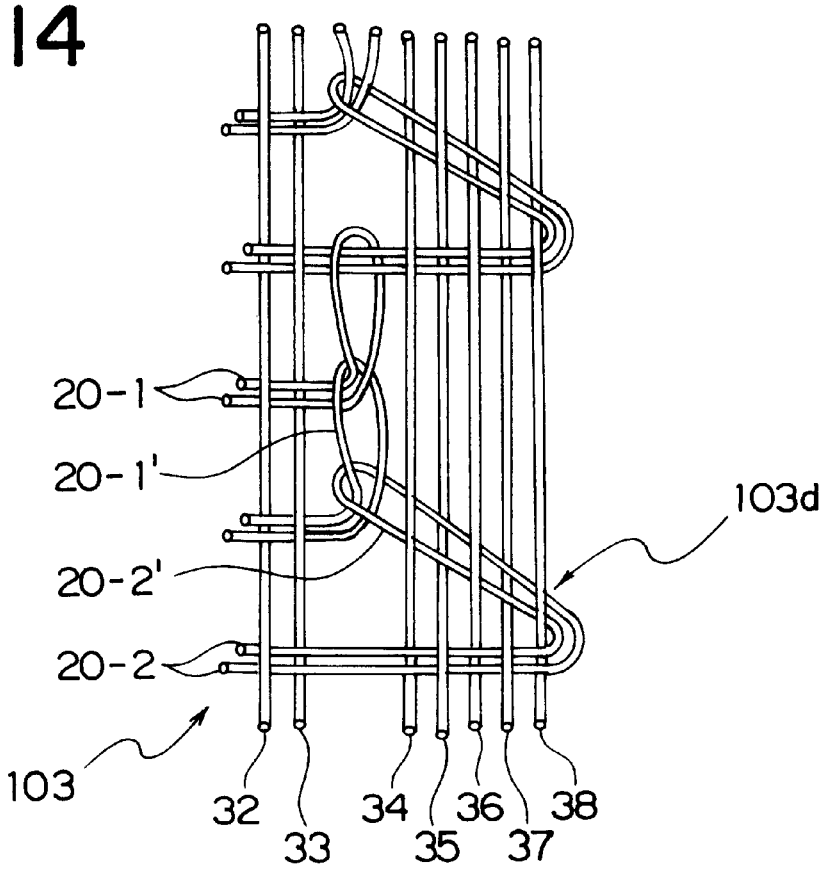
FIG. 14 is a partial plan view showing another modification of the same embodiment.
Figure 15:
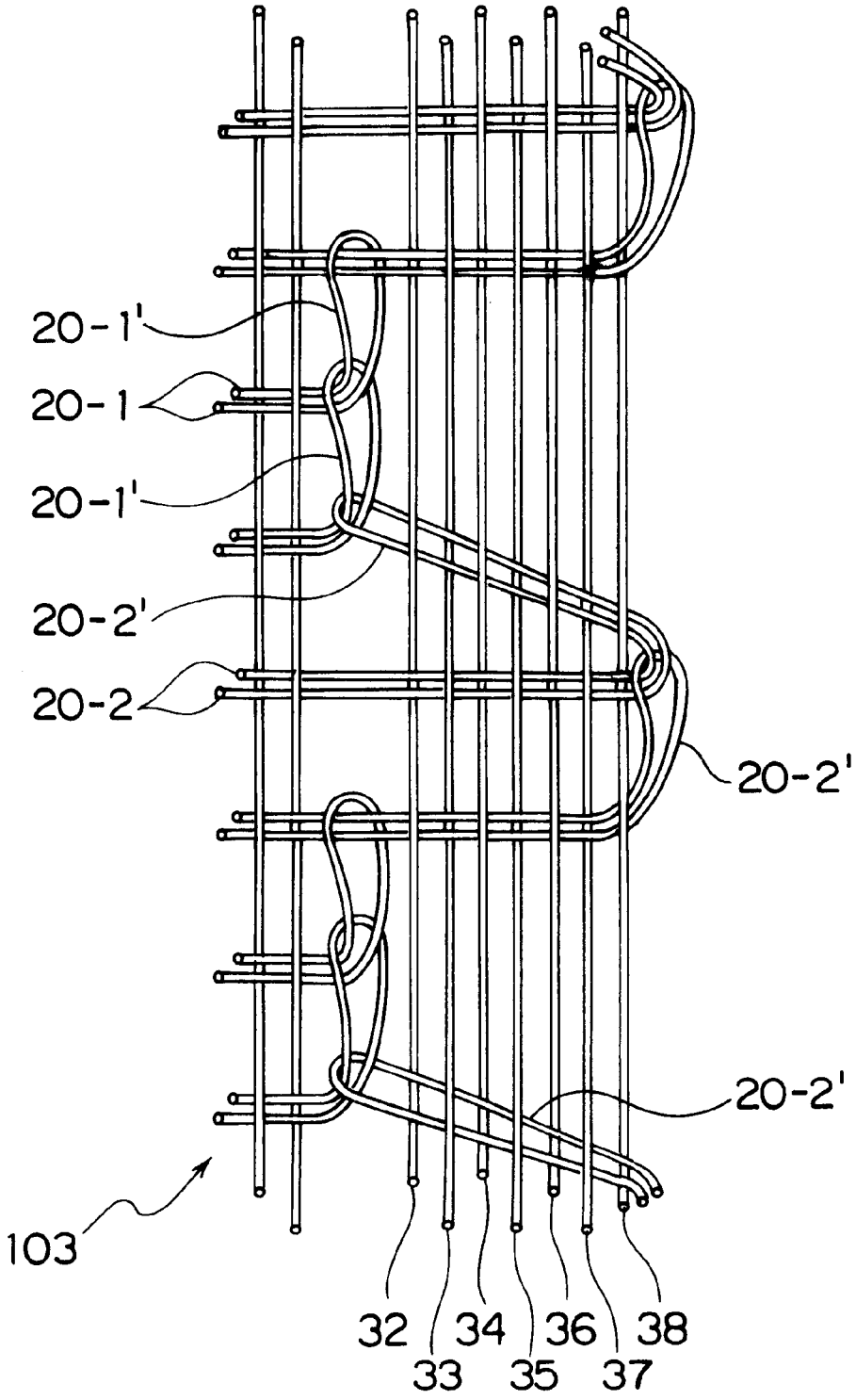
FIG. 15 is a partial plan view showing still another modification of the same embodiment.

FIGS. 13 and 14 show modifications in which the disposition of the first foundation weft yarn 20-1 and the second foundation weft yarn 20-2 are changed in the previously described embodiment. According to a modification shown in FIG. 15, two first foundation weft yarns 20-1 and two second foundation weft yarns 20-2 are disposed alternately. Of the second foundation weft yarns 20-2 arranged in parallel, the second foundation weft yarn 20-2 of next position is inserted into a loop at a return end of two yarns 20*a*-2, 20*b*-2 by double picks of a preceding second foundation weft yarn and after that, the second foundation weft yarn 20-2 of the next position is returned back and caught with seven foundation warp yarns 32 to 38 to be woven.

Figure 16:
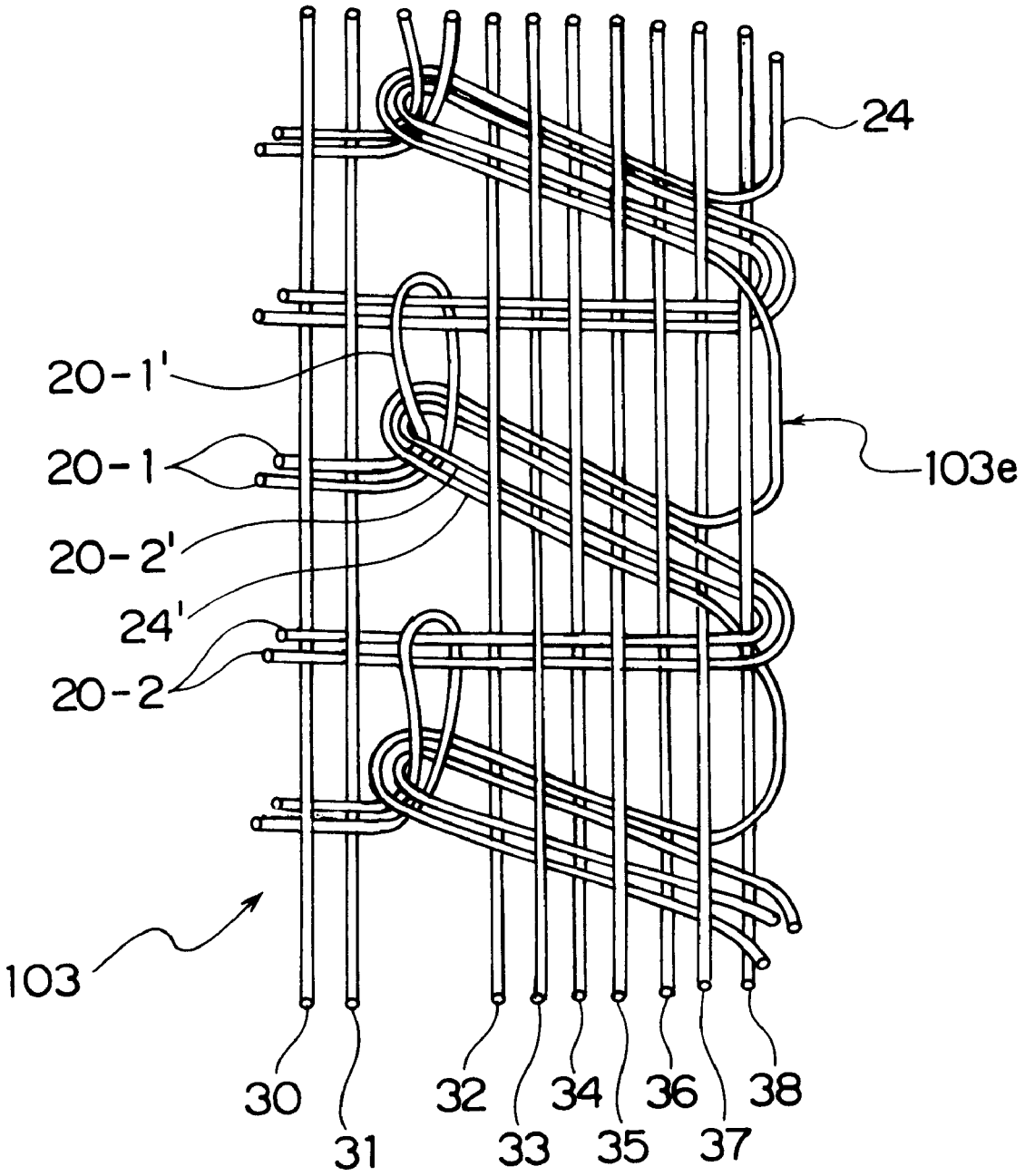
FIG. 16 is a partial plan view showing still another modification of the same embodiment.
Figure 17:
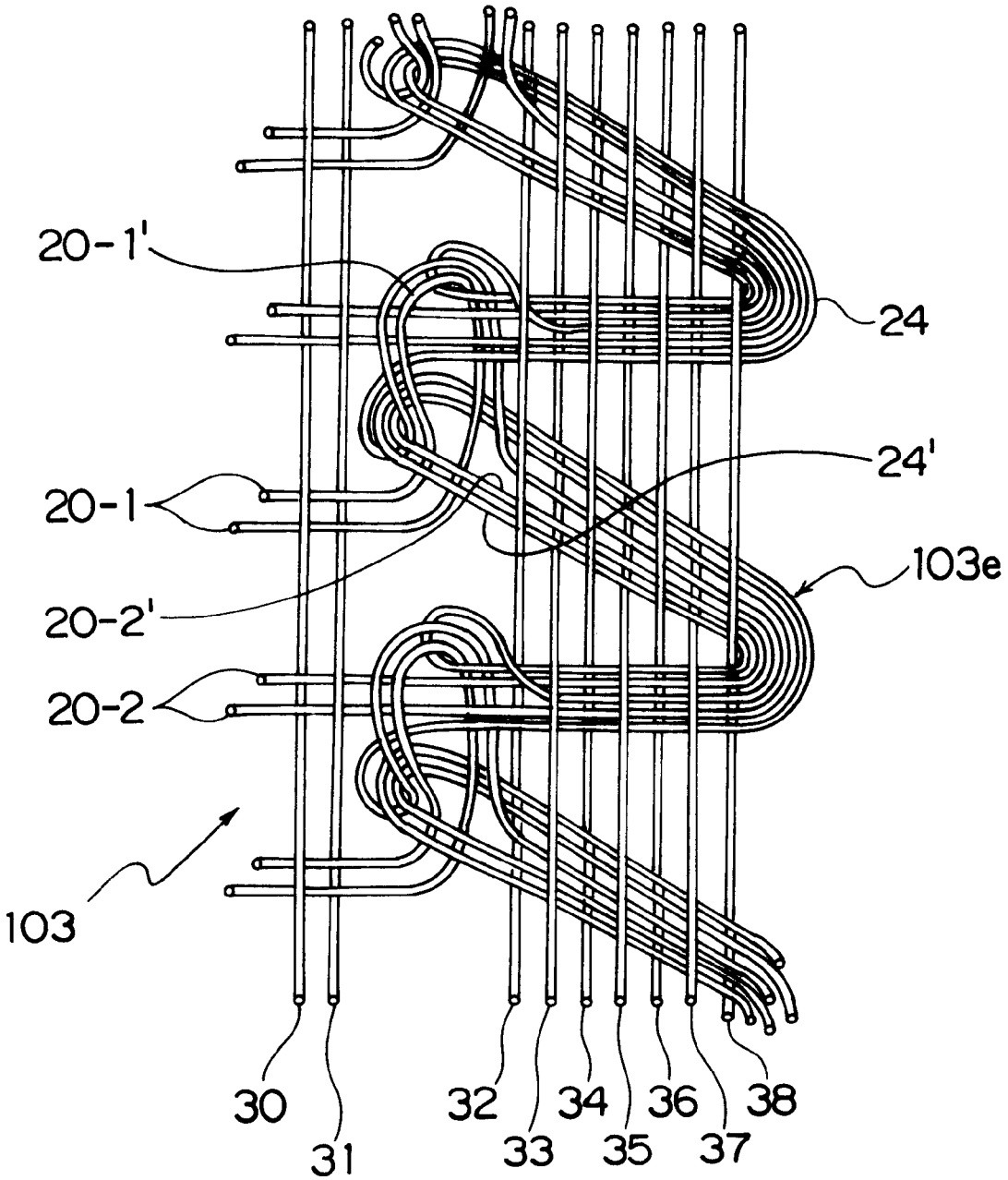
FIG. 17 is a partial plan view showing still another modification of the same embodiment.

FIGS. 16 and 17 show another modifications. According to a modification shown in FIG. 16, the selvage yarn 24 is disposed in addition to the modification shown in FIG. 13 and caught together with the second foundation weft yarn 20-2 with seven foundation warp yarns 32 to 38 so as to weave a selvage portion 103*e*. A loop 24' at an inner side end thereof is caught together with a loop 20-2' at an end of the second foundation weft yarn 20-2 with a loop 20-1' at a return end of the first foundation weft yarn 20-1 inserted into a next position. According to a modification shown in FIG. 17, catching of the selvage yarn 24 with the first foundation weft yarn 20-1 via the loop 24' is carried out not once but twice. By weaving the selvage yarn 24 in this way, the selvage portion of the tape proper region 103 is provided with a larger strength and stiffness.

Figure 18:
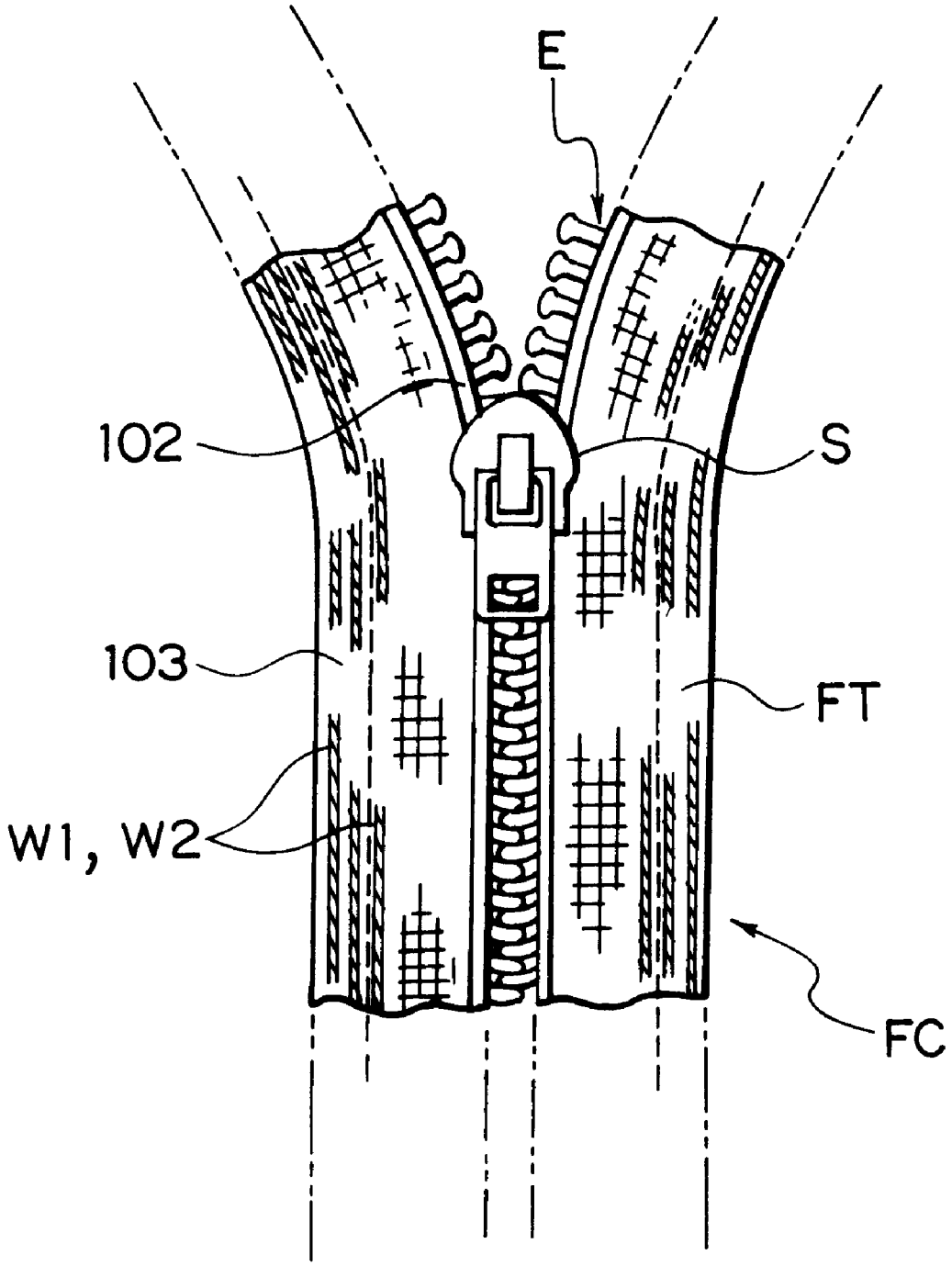
FIG. 18 is a partial plan view of a slide fastener chain in which the belt of the present invention is applied.

FIG. 18 shows a slide fastener chain FC using a fastener tape FT which is a belt of the present invention. A plurality of the fastener elements E attached along a side edge of each of the opposing element attaching regions 102 of a pair of right and left fastener tape FT are engaged with/disengaged from each other by an operation of a slider S. The aforementioned tape proper region 103 of the fastener tape FT is an attaching region to an object to be attached. In the slide fastener chain FC, the element attaching region 102 is formed on a side edge of the fastener tape FT separately from the tape proper region 103.

Figure 19:
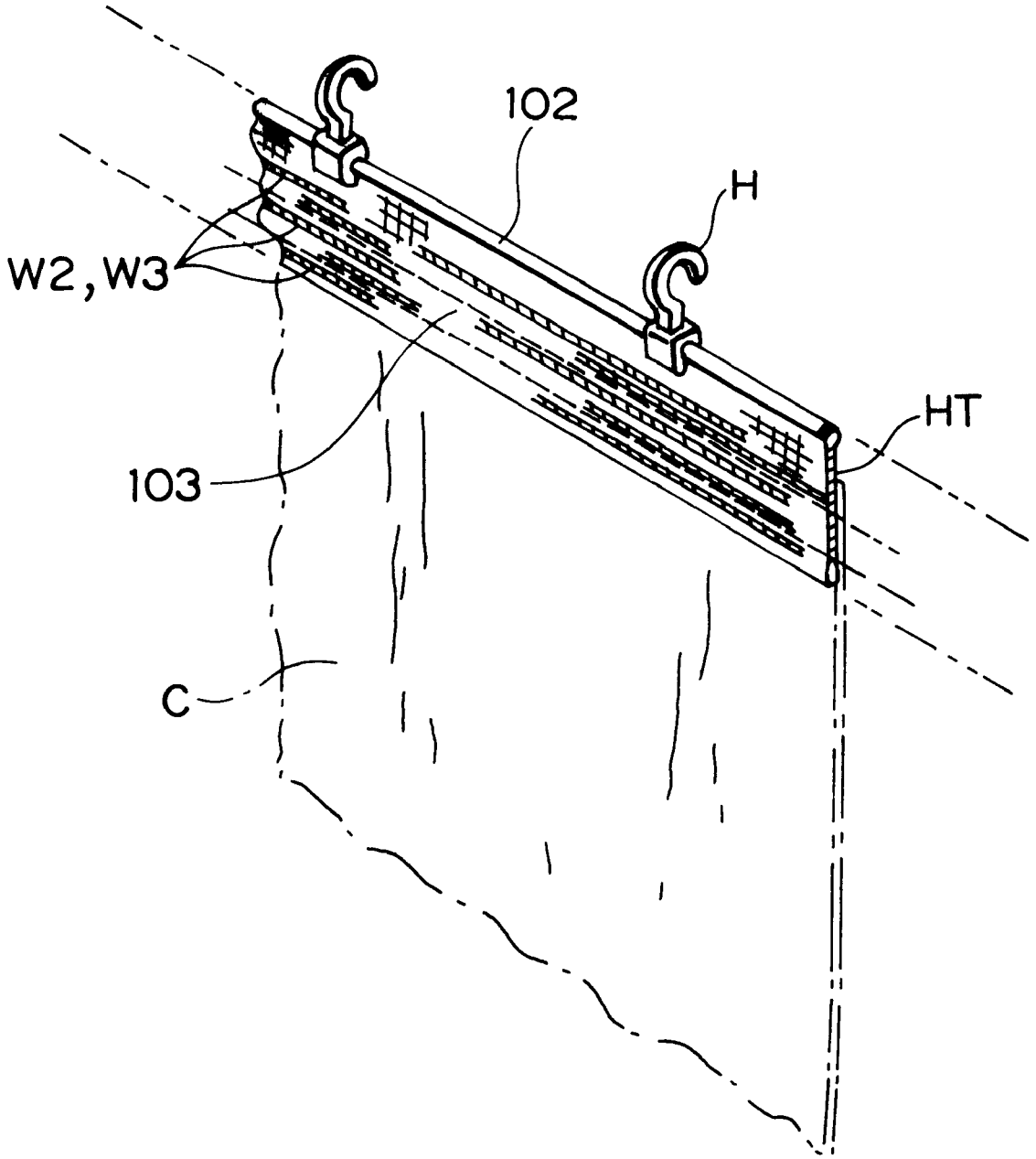
FIG. 19 is a partial perspective view of a curtain to which a header tape employing the belt of the present invention is attached.

FIG. 19 shows a curtain C in which the belt of the present invention is applied to a header tape HT. The aforementioned element attaching region 102 is formed on a side edge of the header tape HT. A plurality of hooks H made of metal or synthetic resin are bound in the longitudinal direction of the element attaching region 102 by crimping or integral molding with a predetermined interval. On the other hand, the tape proper region 103 of the header tape HT is a portion to be sewed directly to the curtain. Because the header tape HT is attached by two sewing lines along a top edge of the curtain as shown here, the aforementioned loop rows W1 to W3 are formed at three-row intervals in the tape proper region 103.

Figure 20:
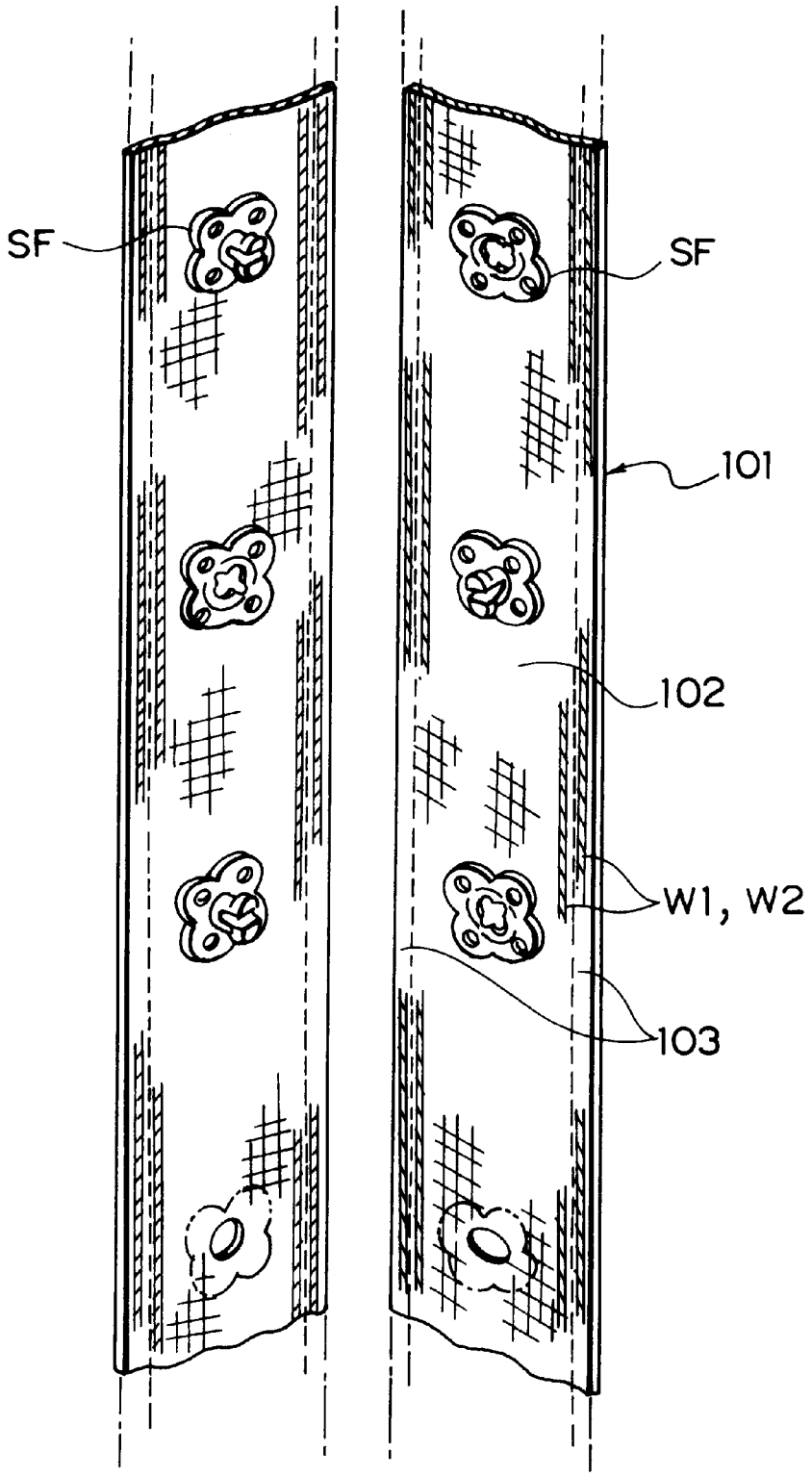
FIG. 20 is a partial perspective view showing male and female engaging elements of a snap fastener with a pair of tapes employing the belt of the present invention by excluding a part thereof.

FIG. 20 shows a snap fastener SF with tape in which a plurality of male engaging elements and female engaging elements are attached alternately at a predetermined interval along a center line of the belt 101 of the present invention. In this belt 101, the aforementioned element attaching region 102 is formed as a region having a predetermined width including the center line of the belt 101 and the tape proper region 103 is formed on both left and right sides thereof.

Figure 21:
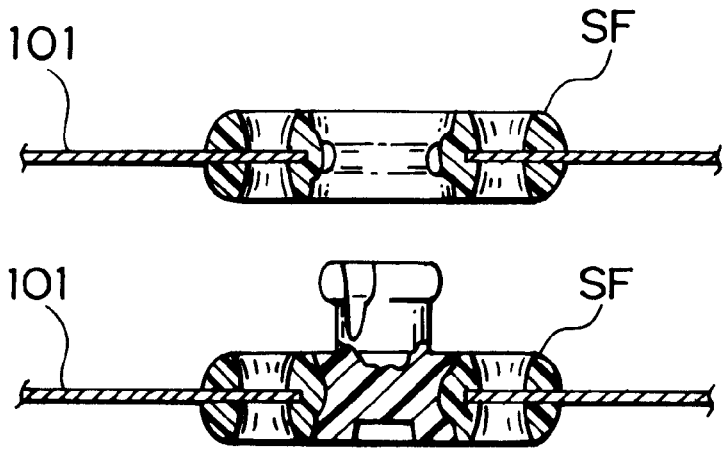
FIG. 21 is a partial sectional view showing an attaching condition of the male and female engaging elements in the snap fastener with tape.

FIG. 21 shows a sectional view of the snap fastener SF when the snap fastener SF is made of synthetic resin and molded integrally along a center line of the belt 101. In this example, an attachment hole is formed in advance in the engaging element attaching portion of the belt 101, and the female engaging element is molded integrally in an annular shape along front and rear peripheries of the attachment hole, so that its inner peripheral face serves as an engaging face of the female engaging element. The male engaging element is produced separately by molding an engaging portion of the male engaging element integrally in a central opening of the female engaging element.

Figure 22:
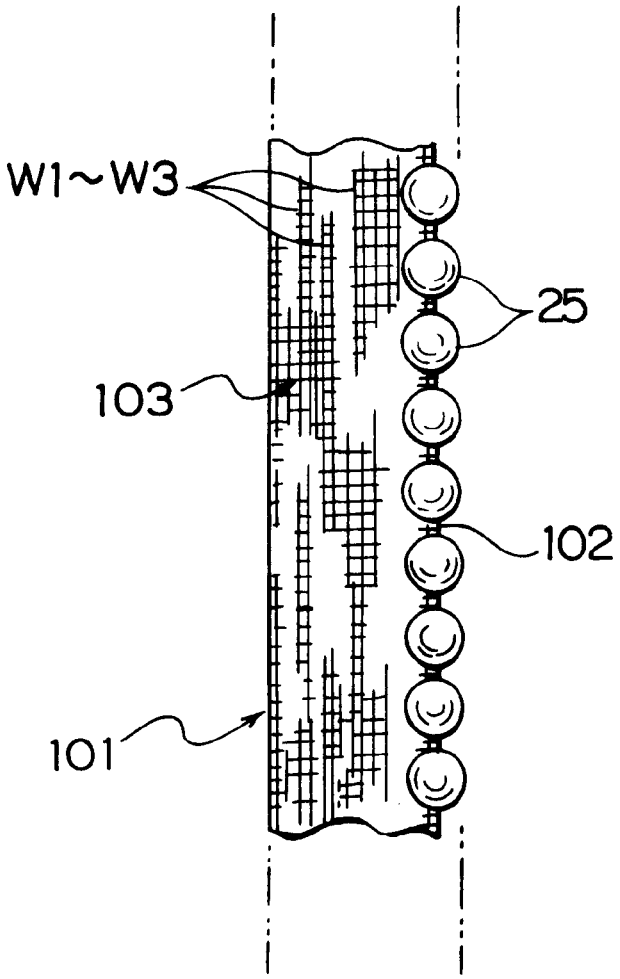
FIG. 22 is a partial plan view of a decorative tape in which brilliant beads are attached to the belt of the present invention.
Figure 23:
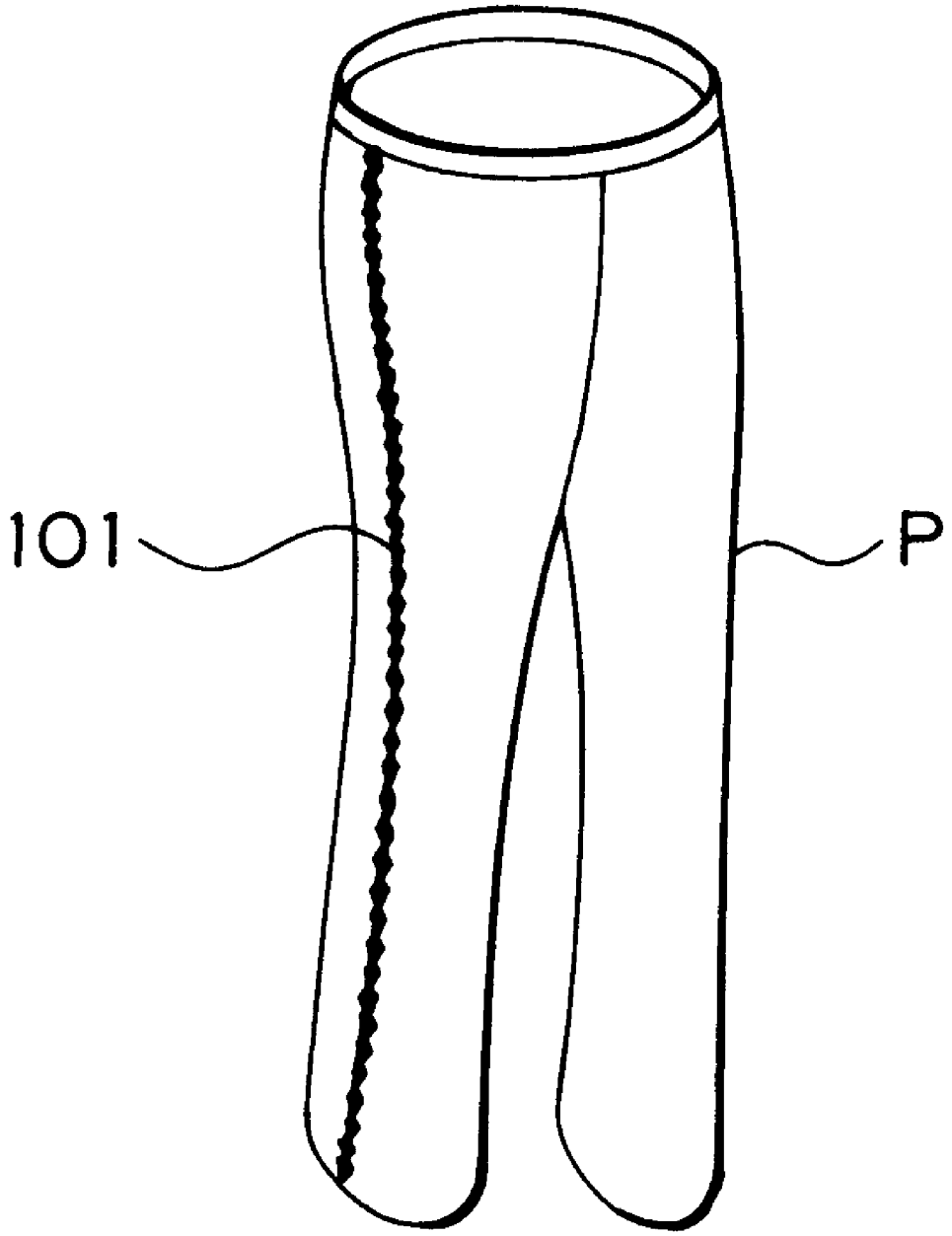
FIG. 23 is an entire perspective view showing a pair of pants to which the decorative tape is attached.

In FIG. 22, a plurality of beads 25 made of, for example, brilliant synthetic resin are integrally attached along a side edge of the element attaching region 102 of the belt 101 of the present invention. Three or more loop rows W1, W2, W3, . . . are formed in the tape proper region 103 except for the element attching region 102, and also act as plural guide lines for sewing. FIG. 23 shows a pair of pants p on which a belt BT with the beads are attached.

as described above, the belt of the present invention is used for diversified applications and by using independently or combining the above described respective embodiments or modifications, a belt which can correspond to each application can be produced. Therefore, the belt of the present invention is not restricted to the above-described embodiments or modifications.

What is claimed is (US):

1. A belt woven with warp yarns and weft yarns, wherein said belt is sectioned to an element attaching region, where elements are attachable to said element attaching region, and a tape proper region in a width direction thereof, said tape proper region being continuous and for the purpose of attaching an object, wherein loops are formed of weft yarns running over substantially an entire width of the belt in said tape proper region while each of said loops is caught with a loop formed with other weft yarns running in parallel to said weft yarns, and wherein the elements are coupling elements, comprising a coil-like coupling element row of a slide fastener and having upper and lower leg portions, the upper and lower leg portions are disposed above said weft yarns in said element attaching region and fixed to said weft yarns by interlacing said weft yarns and warp yarns, and wherein loop rows of said weft yarns are formed near said element attaching region.

2. A belt according to claim 1, wherein said tape proper region comprises weft yarns for forming the loops and warp yarns which catch said weft yarns.

3. A belt according to claim 1, wherein stitches of a warp knitting yarn further catch said caught loops.

4. A belt according to claim 1, wherein said element attaching region is formed only by weaving with warp yarns and weft yarns.

5. A belt according to claim 1, wherein said loops are formed of all weft yarns adjacent each other and the respective loops catch each other successively in the longitudinal direction of the belt so as to form continuous loop rows in the longitudinal direction of the belt.

6. A belt according to claim 1, wherein the entire tape proper region is formed by catching of the loops of the weft yarns.

7. A belt according to claim 1, wherein said weft yarn consists of two yarns running in the same warp yarn opening in a reciprocating manner.

8. A belt according to claim 7, wherein said weft yarn consists of two yarns running in the same warp yarn opening in a reciprocating manner and said loops are formed by one and the same of said two yarns.

9. A belt according to claim 7, wherein said weft yarn consists of two yarns running in the same warp yarn opening in a reciprocating manner and both of said two yarns form said loops each in double.

10. A belt according to claim 7, wherein each of said two yarns consisting of the weft yarn forms loops at a predetermined pitch in a width direction of the tape proper region while the loops of the yarn are caught with loops formed by the corresponding yarn of the adjacent weft yarn.

11. A belt according to claim 7, wherein the weft yarn consisting of two yarns running in the same warp yarn opening in a reciprocating manner comprises one or more first weft yarns returning in said tape proper region and a second weft yarn disposed subsequent to said first weft yarn and forming a tape selvage portion by weaving at an outside edge of the tape proper region, while a loop formed at a return end of said first weft yarn next to said second weft yarn is caught with a loop formed at a return end of said second weft yarn.

12. A belt according to claim 11, wherein a reinforcement yarn is inserted into said tape selvage portion while said reinforcement yarn is caught with said loops of said first weft yarn in the tape proper region which also catches said second weft yarn.

13. A belt according to claim 1, wherein said element attaching region is disposed in the central portion in the width direction of the belt and said tape proper region is disposed on both side edges in the width direction of the belt.

14. A belt according to claim 1, wherein said element attaching region is disposed on one side edge in the width direction of the belt while said tape proper region is disposed on the other side edge in the width direction of the belt.

15. A belt according to claim 1, wherein two or more element attaching regions and tape proper regions are disposed alternately.

* * * * *